US010621680B2

(12) United States Patent
Mullaney

(10) Patent No.: US 10,621,680 B2
(45) Date of Patent: Apr. 14, 2020

(54) SYSTEM AND METHOD FOR ALERTING USERS TO DIGITAL CONTENT OBJECTS OF POTENTIAL INTEREST

(71) Applicant: NewsWhip Media Limited, Dublin (IE)

(72) Inventor: Andrew Mullaney, Dublin (IE)

(73) Assignee: NEWSWHIP MEDIA LIMITED, Dublin (IE)

( * ) Notice: Subject to any disclaimer, the term of this patent is extended or adjusted under 35 U.S.C. 154(b) by 290 days.

(21) Appl. No.: 15/397,126

(22) Filed: Jan. 3, 2017

(65) Prior Publication Data

US 2018/0189402 A1 Jul. 5, 2018

(51) Int. Cl.
*G06Q 50/00* (2012.01)

(52) U.S. Cl.
CPC ..... *G06Q 50/01* (2013.01)

(58) Field of Classification Search
None
See application file for complete search history.

(56) References Cited

U.S. PATENT DOCUMENTS 8,234,263 B2 7/2012 Pradhan et al.
9,569,467 B1 * 2/2017 Schechter ..... G06F 16/27
2007/0299678 A1 * 12/2007 Kido ..... G06Q 10/00 705/35
2010/0257113 A1 * 10/2010 Dorrell ..... G06Q 10/10 705/319
2014/0006314 A1 * 1/2014 Yu ..... G06Q 30/02 705/412
2015/0106078 A1 4/2015 Chang
2016/0055164 A1 * 2/2016 Cantarero ..... G06F 16/447 707/740
2016/0232241 A1 * 8/2016 Stoyanov ..... G06F 16/9535
2016/0359790 A1 * 12/2016 Zhang ..... G06F 16/285
2016/0373397 A1 * 12/2016 Kesten ..... H04L 51/32
2017/0039305 A1 * 2/2017 Shakarian ..... G06F 17/5009

* cited by examiner

*Primary Examiner* — Alex Gofman
*Assistant Examiner* — Umar Mian
(74) *Attorney, Agent, or Firm* — Ohlandt, Greeley, Ruggiero & Perle, L.L.P.

(57) ABSTRACT

A method and system for processing digital content objects, such as news stories, are provided. A user specifies digital content objects of interest. The user specification is then applied to a source of digital content objects in order to obtain a batch of digital content objects matching the specification. A value of a variable, such as a social media impact metric, is then determined for each of the digital content objects of the batch and these values are fitted to a distribution function in order to determine parameter values for the distribution function. A threshold value for alerting is then determined based on the parameterized distribution function. The specification can then continue to be applied to the source of digital content objects and when new digital content objects are found that match the specification, their values are compared against the threshold value for alerting and the user is alerted only in respect of new digital content objects that have values which exceed the threshold value.

26 Claims, 15 Drawing Sheets

HOSTED SERVICE SPACE
User Interface
30
Entity Ranking
Object (Story) Ranking
User Alerts
410
401
403
Entity Scoring Module
NER Classifier
Object (Story) Scoring Module
Alerting Module
20
300
400
500
503
506
505
101
120
104
200
Tracking Module
Parsing Module
Categorization Module
Activity Measurement Module
10
105
107
100
103
WEB SPACE
RSS
Web Crawler
News Agency
Facebook
Twitter
LinkedIn
102a
102b
102n
112a
112b
112n

SYSTEM AND METHOD FOR ALERTING USERS TO DIGITAL CONTENT OBJECTS OF POTENTIAL INTEREST

BACKGROUND OF THE DISCLOSURE

1. Field of the Disclosure

The present disclosure relates to a system and a method for alerting users to digital content objects of potential interest.

2. Description of the Related Art

Social media impact of a digital content object, such as a news story, can be measured by how much it is trending. Trending can be measured, for instance, by counting the numbers of shares, tweets and other engagements that a digital content object has attracted over a given period of time. For Facebook®, these engagements can mean a share, like or comment; for Twitter®, a tweet or retweet of a link; and for LinkedIn®, a share of the content. Other social network platforms use similar indicia by which user engagement with a digital content object can be registered and tracked.

A user who has particular interests, whether professionally or for leisure, would like to be alerted so that he or she is informed at an appropriate time of news stories or other digital content objects of potential interest. A user who is a football fan of a particular team, for example, would want to be alerted, if that football team signs a big-name player. On the other hand, the same user probably does not want to be alerted, if his football team signs a youth player. A user who owns a particular stock, for example, would want to be alerted to significant unexpected changes in the share price. On the other hand, the same user would probably not be interested if the share price falls by the same amount in some predictable manner, such as ex-dividend.

The problem is that it is difficult to determine when a news story is big, and specifically big enough that a particular user would want to be alerted to it. What might be considered a big story in one category or location may not be considered big in another. Over-frequent alerting, or alerting to news stories that the user looks at and decides were not of interest, will quickly lead the user to reject a whole alerting source as junk. Although the user can be asked what he or she is interested in and how often he or she wishes to be alerted, this on its own is not sufficient to allow an automated method to decide what news stories should be alerted to a particular user. What is a big news story today might not be big tomorrow.

SUMMARY OF THE DISCLOSURE

The following briefly describes a basic understanding of some aspects of the embodiments. Its purpose is merely to present some concepts in a simplified form as a prelude to the more detailed description that is presented later.

Described herein are embodiments of a computer system, method, and computer program products for a digital content object collection and tracking system comprising a user interface unit and an alerting module. The user interface and alerting module can be configured to permit a user to configure a digital content object panel specification to define a set of alert criteria for digital content objects and subsequently to send alerts to the user regarding digital content objects that match the panel specification. The configuration of a digital content object panel specification to define characteristics of digital content objects of interest allows the system to understand the context in which the user wants to be alerted.

In an embodiment, the alerting module can be configured to apply the panel specification to a database of digital content objects and obtain a batch of digital content objects matching the panel specification. The alerting module can be configured to:

determine a value of a variable for each of the digital content objects of the batch;

fit the values of the variable for each of the digital content objects to a distribution function to determine parameter values for the distribution function;

determine a threshold value for alerting based on the parameterized distribution function;

determine a value of the variable for an additional digital content object matching the panel specification; and instruct the user interface unit to alert to the additional digital content object conditional on the value of the variable for the additional digital content object exceeding the threshold value.

With a parameterized distribution function it is then possible to assess a current digital content object through the same variable. Alerting can then be done based on comparing the current impact level, i.e. score, against the impacts of a comparable group as defined by the parameterized distribution function. An alert threshold can thus be set in terms of the probability that the current score is achieved by comparable digital content objects.

In an embodiment, the system can continually update the group of digital content objects matching the specification, and, based on the updated group, update parameter values for the distribution function; update the threshold value for alerting based on the updated parameter values for the distribution function.

In an embodiment, the alert threshold can be adjusted based on a comparison between actual alert frequency and user-specified desired alert frequency. In this way, the frequency of alerts can be adjusted to match the user's desired alert frequency.

Accordingly, embodiments as described herein provide a technology solution to conventional alerting for digital content object tracking systems, which cannot identify or distinguish stories of interest to a user. Another exemplary advantage is the technology can prevent alarm fatigue caused notifications that are too frequent or of insufficient interest to a user.

BRIEF DESCRIPTION OF THE DRAWINGS

Embodiments will now be further described, by way of example only, with reference to the accompanying drawings.

DETAILED DESCRIPTION OF THE EMBODIMENTS

Figure 1:
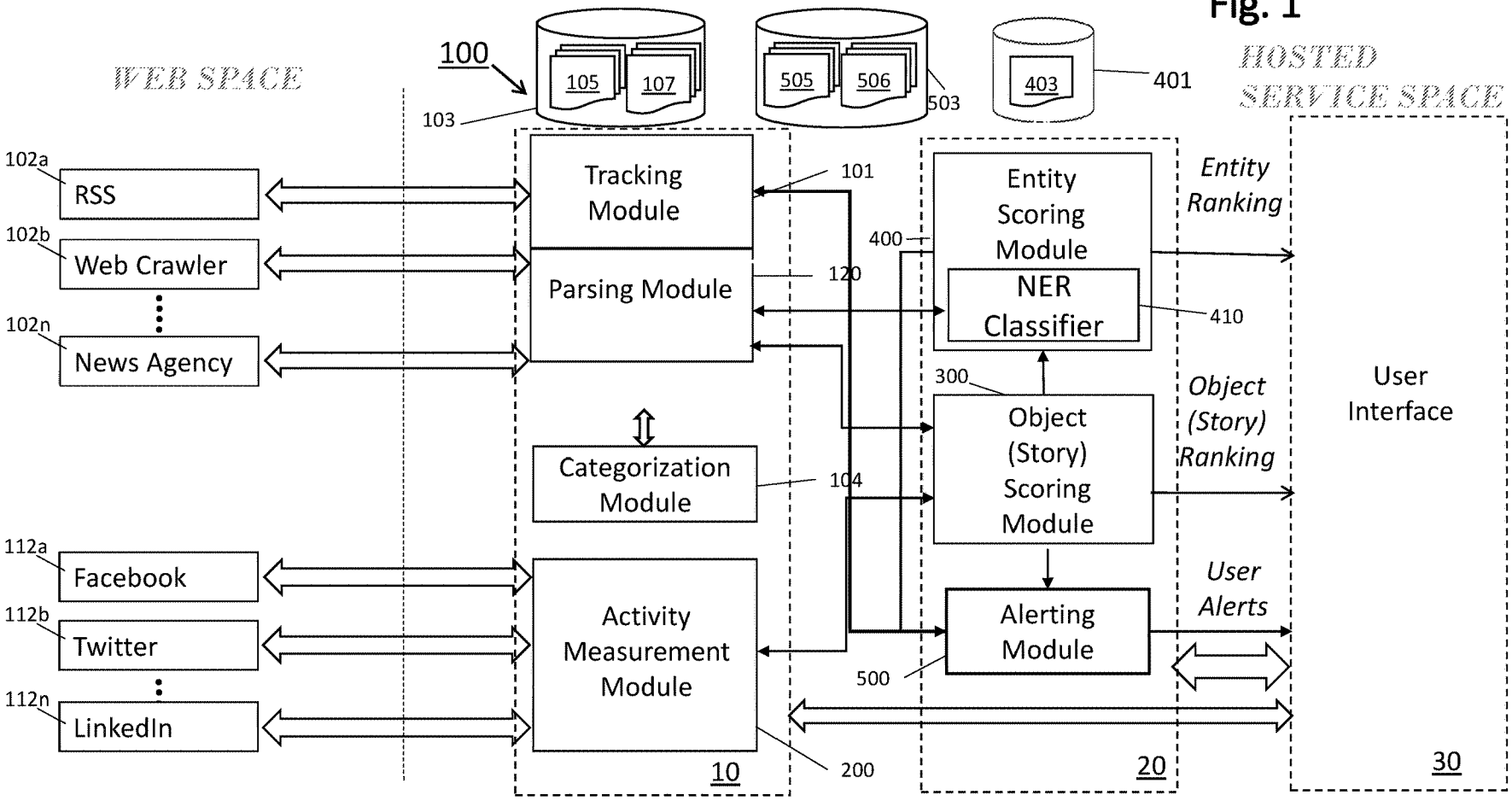
FIG. 1 is a block diagram of logical architectures of a digital content object analysis system according to one or more embodiments of the present disclosure.

Various embodiments now will be described more fully hereinafter with reference to the accompanying drawings, which form a part hereof, and which show, by way of illustration, specific embodiments by which the invention may be practiced. The embodiments can, however, be embodied in many different forms and should not be construed as limited to the embodiments set forth herein. Rather, these embodiments are provided so that this disclosure will be thorough and complete, and will fully convey the scope of the embodiments to those skilled in the art. Among other things, the various embodiments can be methods, systems, media, or devices. Accordingly, the various embodiments can take the form of an entirely hardware embodiment, an entirely software embodiment, or an embodiment combining software and hardware aspects. The following detailed description is, therefore, not to be construed in a limiting sense.

Throughout the specification and claims, the following terms take the meanings explicitly associated herein, unless the context clearly dictates otherwise. The term "herein" refers to the specification, claims, and drawings associated with the current application. The phrase "in one embodiment" or "in an embodiment" as used herein does not necessarily refer to the same embodiment, though it may. Furthermore, the phrase "in another embodiment" as used herein does not necessarily refer to a different embodiment, although it may. Thus, as described below, various embodiments of the present disclosure can be readily combined, without departing from the scope or spirit of the present disclosure.

In addition, as used herein, the term "or" is inclusive, and is equivalent to the term "and/or," unless the context clearly dictates otherwise. The term "based on" is not exclusive and allows for additional factors to be included that are not described, unless the context clearly dictates otherwise. In addition, throughout the specification, the meaning of "a" "an" and "the" include plural references. The meaning of "in" includes "in" and "on".

In the following detailed description, digital content objects are described in terms of news feeds and as news stories. Examples of news story types are: journalistic articles, online reviews, blogs, posts, conversations, and natural language content of videos. It will be understood that embodiments can be applied to other digital content objects including or not including a natural speech element or having or not having a natural speech element derived therefrom and capable of being analyzed for the purpose of generating user alerts in the manner described.

In the following detailed description reference is made to natural language processing (NLP) which is a field of computer science, artificial intelligence (AI), and computational linguistics concerned with the interactions between computers and human (natural) languages. One AI data analysis approach is based on identifying named entities from the natural language elements of digital data. Named entities are persons, organizations, locations or other text elements that can be located and classified into pre-defined categories. Named-entity recognition (NER), also known as entity identification and entity extraction, is an AI task that seeks to locate these text elements in a stream of text and classify them.

Referring to FIG. 1, the digital content object system is generally represented by reference numeral 100. Embodiments herein are shown as digital news story analysis system 100 according to an embodiment together with associated external elements. As noted herein, although embodiments are described using news stories as digital content objects, the system 100 can be used for any form of digital content objects that are sourced to the system 100 and engaged via social media platforms 112*n*. The right-hand portion of the FIG. 1, bounded by vertical dashed line, and labelled as the hosted service space, shows operational modules of the system. The left-hand portion, labelled web space, shows sources of digital content objects—news stories—as well as the social media platforms that engage with those news stories which are on the Internet. The digital content object sources and social media platforms also exist in another information space, such as a company intranet, where documents and other content are identified by URLs interlinked by hypertext links (hyperlink for short). A hyperlink is a link to a web page, wherein the link includes an anchor and a reference to the uniform resource locator (URL) for the web page.

The basic units of the news story analysis system are a data collection unit 10, a trending unit 20 and a user interface unit 30. The data collection unit 10 is configured to collect social media data from social media platforms and content data from news story sources. The trending unit 20 is configured to calculate the social media impact of news stories and produce appropriate output relevant for a user based on the social media impact, which it does through an object scoring module 300, an entity scoring module 400 and a user alerting module 500. The role of the alerting module 500 is to send alerts to a user based on the user's pre-defined selection criteria for digital content objects, wherein the user is only alerted about digital content objects that are tracked by the tracking module 101 and are determined to be of sufficient relevance to the user based on their social media impact compared to other similar digital content objects as defined by their current score as determined by the object scoring module 300. The user interface unit 30 is configured to communicate with users so they can interact with the trending unit 20 and extract useful data therefrom, for example extract news information of interest based on user-configured filters in combination with story-based and entity-based rankings computed by the trending unit 20 as described herein. In an embodiment, the system is configured to allow a user to configure a panel specification that the system uses to optimize the alerting module 500 to provide bespoke alerting to the user. The user interface unit 30 can also allow user interaction with the data collection unit 10. It will be understood that the user interface can conveniently be web-based, but could be hosted inside by a proprietary network connected to the system via point-to-point communication lines.

A first group of elements in web space are news story sources 102*a*, 102*b* . . . 102*n* where content resides, labelled by, for example, as RSS (Rich Site Summary), Web Crawler and News Agency. Other example news story sources are Facebook public feed and FB Open Graph (Facebook Open Graph), Twitter streaming and Reddit. RSS sources can originate from conventional media news outlets or agencies such as BBC News, Sky News, NBC News, Fox News and Reuters or from corporations or public bodies, such as multi-national corporations and universities.

A second group of external elements in web space are social media platforms 112*a*, 112*b* . . . 112*n* on which users engage with the news stories that reside on the news story sources, labelled by way of example, as Facebook, Twitter and LinkedIn. It is noted that one or more of the social media platforms can also contain news stories, so can also constitute news story sources 112*n*, for example social media platforms that include blogging platforms, such as Medium, LinkedIn and Tumblr. A social media platform running on a network is configured to allow users to use software and application enabled interfaces to publish or distribute information to one another. Other common social media platforms that can supply raw data for collection, include but are not limited to, Pinterest, Tumblr, Instagram, Medium, and Reddit. Social media platforms also include internal social media platforms that may run solely on one organisation's intranet system.

System 100 software is hosted by a computer that is connected to the world wide web. The computer can be a server as, for example, described in more detail with respect to FIGS. 8-9. The system 100 is connected in operative communication with the news story sources 102*n* and social media platforms 112*n*.

The system is configured to trawl the web for news stories, measure how much engagement they are attracting on one or more social media platforms, i.e. how trending they are, and from the trending data produce separate rankings for how trending the news stories are, and how trending are the named entities mentioned in those news stories. Outputs of the system include a news story ranking and an entity ranking.

Figure 4:
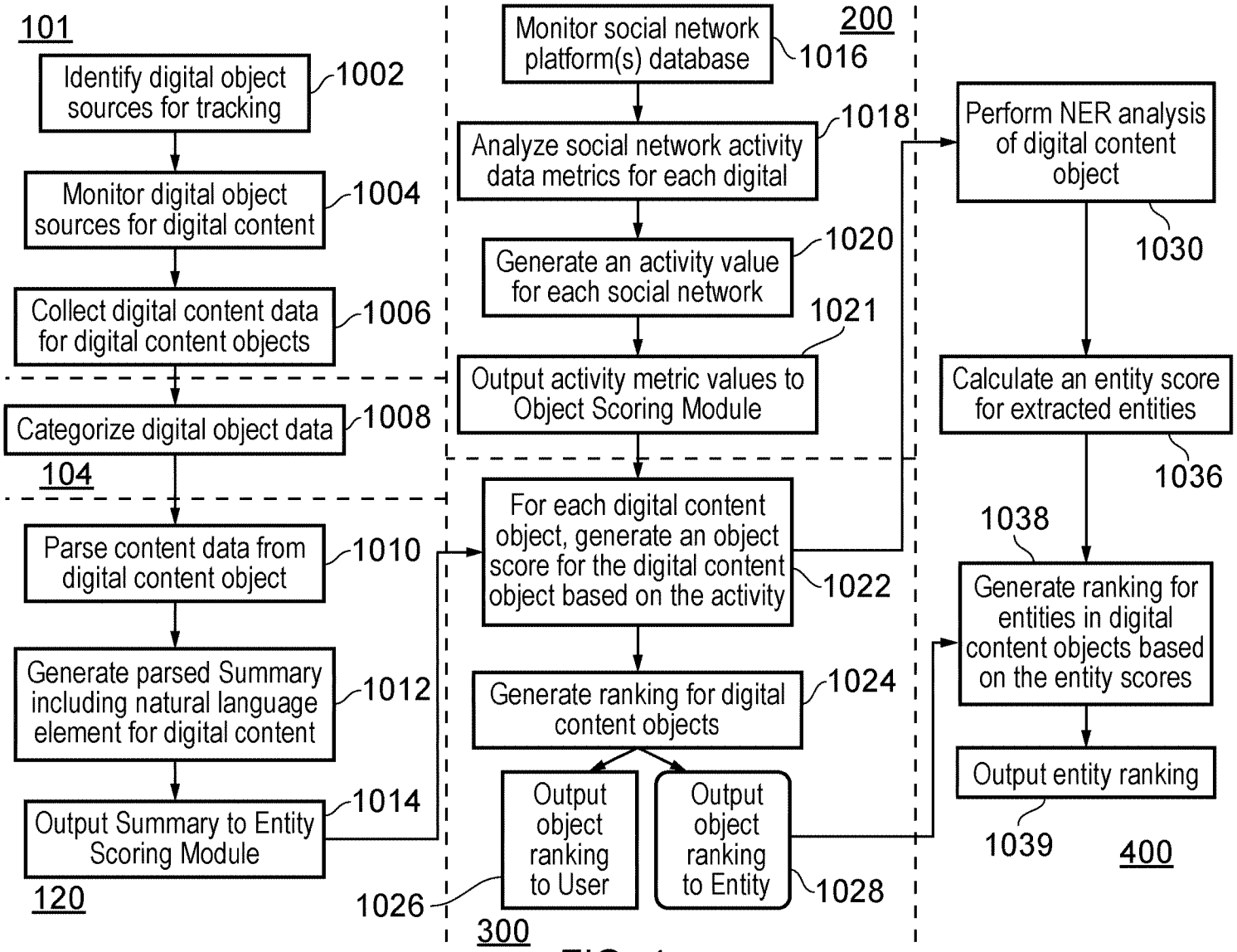
FIG. 4 is a high-level flow chart showing embodiments of system modules' operation.

Embodiments of the system's 100 modules are now described in conjunction with FIG. 4. The same reference numbers are given for the same components throughout this disclosure.

In at least one embodiment, at block 1002, the tracking module 101 is configured to track and identify at least one digital object within one or more digital object sources 102*a*, 102*b* . . . 102*n*. The one or more digital object sources 102*a*, 102*b* . . . 102*n*, which generally can be some form of content producing digital platform as described above, such as a website, can be first identified, and can then be monitored by the system 100. The digital object sources 102*a*, 102*b* . . . 102*n* can be identified by an end user of the system 100, an administrator of the system 100, or an automated process in the system 100, such as a web crawler or a computer program that can browse the world wide web or pre-identified portions of the world wide web to detect and/or index content. For example, in at least one embodiment of the system 100, an administrator or end user of the system 100 can manually identify sources in one or more websites, can manually categorize the sources, and can use the categorized sources for the system 100. The source can be, for example, an RSS feed or a particular subsection of a website where a given category of content is published. These sources can be used to identify and categorize digital objects.

In at least one embodiment, at block 1004, after at least one digital object source 102*a*, 102*b* . . . 102*n* is found, the tracking module 101 is configured to monitor at least one digital object source 102*a*, 102*b* . . . 102*n* for new digital content objects. In at least one embodiment, the at least one digital object source is a news story source and the digital content objects are digitally published news stories. The monitoring process can employ a web crawler or other computer program to identify new digital content objects within or from the digital object source 102*a*, 102*b* . . . 102*n*, or can be configured to receive published announcements or syndication from the digital object source 102*a*, 102*b* . . . 102*n*. An automated process can be used by the news story tracking module to identify the news story sources, such as a web crawler that systematically browses the world wide web. The web crawler can be part of the tracking module, or can be externally accessed as a news story source as shown by the label in box 102*n*. In an embodiment, a software product or service external to the system 100 can be used for the identification of new digital content objects. For example, in at least one embodiment of the system 100, the system 100 can monitor RSS feeds and crawl websites programmed into or pre-selected by an operator of the system 100. The digital object can comprise a news story, video, audio file, blog, event, topic, photograph, product website, product webpage, political website, political webpage, music, other media, or any digitally stored object embodied in some form on the internet, a local network, or some other form of sharing digital data. A digital object can be identified by, for example, a URL, a hyperlink, or any other unique digital identifier for the digital object on the world wide web. The tracking module 101 can be based on a computer, a server, or spread across an array of linked computers or servers.

Alternatively, the news story sources to be monitored can be pre-configured by a system administrator. A news story can be identified by, for example, an URL, a hyperlink, or any other unique digital identifier for the news story on the world wide web. A news story source can be a website or a subsection of a website, for example.

In at least one embodiment, at block 1006, the identified digital content objects are collected in a digital content object database 103 for processing.

In at least one embodiment, at block 1008, when the tracking module 101 identifies and collects one or more digital content objects, the categorization module 104 can categorize the digital content objects of the digital object sources 102*a*, 102*b* . . . 102*n*. In at least one embodiment, the categorization module 104 is operatively connected to a tracking module 101 and parsing module 120. The categorization module 104 is configured to ascribe categories to news stories identified to it by the tracking module 101. The data used for the categorization process can include, for example, information previously determined and inputted regarding at least one of the digital object sources 102*a*, 102*b* . . . 102*n*, information derived from the one or more digital object sources 102*a*, 102*b* . . . 102*n*, information stored in the system 100, and information requested from an external source. The categorization module 104 can be pre-configured by a system administrator. For example, different news story sources may be tagged with categories such as: country of origin (US, UK, Ireland, China . . . ); language (English, Chinese, Japanese, German . . . ); subject matter (business, technology, sport . . . ). The categorization module 104 can categorize news stories using: metadata containing information that indicates that the object is of a certain type; forms of digital content associated with the news story (such as video, audio, image, or other file types); keywords associated with or contained in text content of the news story; categorization by a third party source, such as an external index that indicates that a news story is of a certain type, or that objects associated with a particular news story source are of a certain type; categorization by system users; categorization by system administrators; or categorization by social network users.

For example, in an embodiment the categorization module 104 can use data inputted by an administrator or end user of the system 100 in order to correctly categorize the digital content object. For example, categorization data can include categories based on editorial categories configured by an administrator. The administrator can input data to identify a digital object source 102*a*, 102*b* . . . 102*n* as being located in the United Kingdom ("UK"), and producing or linking to content relating to technology and business. The categorization module 104 can automatically categorize any digital content object data from this source 102*a*, 102*b* . . . 102*n* as UK, technology, and business. Thus, data from digital content objects 105 for one or more digital object sources 102*a*, 102*b* . . . 102*n* can be collected in a database 103 and categorized.

In at least one embodiment, at block 1010 the object parsing module 120 is configured to gather data from a digital content object and parse the data. The data the parsing module 20 can extract from the digital object can include, for example, a picture, text, a video file, an audio file, metadata, or some other information. In at least one embodiment, at block 1012, the data from the digital content object is parsed so that a parsed summary representing the digital object can be provided. The parsed summary can be a parsed summary file 107 representing the digital object.

In at least one embodiment, the parsing module 120 is configured to parse news stories and to obtain categorization for them. For example, when the digital object is a news story containing text and an image, the parsed summary file 107 or files can contain a headline from the news story; some keywords associated with the story; summary text relating to the story; a thumbnail picture or other rendering of the image associated with the story; the publication or website or other digital platform where the story may be found; feedback or reactions relating to the story from third parties, system users, or social network users.

In at least one embodiment, at block 1014, the parsing module is configured to create, store and make available for output a summary file 107, for example, of a news story, which includes a natural language element (typically in the form of text) on which entity recognition can be performed by an NER classifier as described herein. The summary file 107 may optionally also include some multimedia content such as a thumbnail image representative of the news story. The parsing can be category dependent, so the parsing module 120 is in operative communication with the categorization module 104 to obtain categorization data for the news stories which it is parsing and store this categorization data with the other parts of the parsed information relating to the news story. Exemplary parsing engines suitable for use in the present parsing module include those described in U.S. Pat. No. 8,234,263 B2 and the named entity extractor and natural language parser described in US 2015/0106078 A1, the entirety of each of which are incorporated by reference hereby.

Of course, data collection module 10 can be configured collect and to output summary files 107 as well as digital content object files 105 including, among other content, some or all of the natural language elements in the file to the trending unit 20 for AI natural language processing and NER processing. In embodiments, these files 105, 107 can be processed stored and output for batch processing or streamed or otherwise provided an individual basis.

An activity measurement module 200 is configured measure to social media activity and engagement metrics for a particular digital object. Social media activity and the associated metric(s) include measurable user-related activity or action within a social media platform. It will be understood that different social media platforms 112*n* can have a mixture of common and differing metrics depending on how each one is designed. Examples of social media activities that can be captured by an associated metric include, but are not limited to:

- publishing a link to a news story on a social media platform (such as, "sharing" a story via Facebook or publishing the news story as a post on Twitter);
- recommending a news story using tools available through the social media platform (such as, "liking" or "recommending" via Facebook);
- using social media to comment on or discuss a news story provided or published by another user (such as, making a comment or otherwise interacting with a link shared by another user on Facebook);
- posting or sharing a link to a news story within a social media platform (for example, publishing a link on Twitter or sharing a link on Facebook);
- commenting on a link to a news story shared within a social media platform (such as a photo or other content published within the social media platform);
- using a social media account to comment on or otherwise interact with or engage with a news story (such as using a Facebook or Twitter account to post a comment on a news article or blog post);
- using a social media account to recommend, approve of, or otherwise promote a news story; using a social media platform to publish an opinion, reaction or comment relating to a news story;
- using a social media platform to distribute or communicate a news story; interacting socially with a news story within a social media platform. The activity measurement module 200 may measure any or all of these actions relating to a social network or to a particular social network account.

In at least one embodiment, at block 1016, the activity measurement module 200 is operative to communicate with the social media platforms 112*a*, 112*b* . . . 112*n*, for example, via a web service application programming interface provided by the social media platform. At block 1018, the activity measurement module 200 is configured to analyze social network activity data metrics for each digital content object. For example, the activity measurement module 200 measures the engagement in social media with a digital content object, for example a news story, using one or more metrics such as described above. In at least one embodiment, at block 1020, the activity measurement module 200 is configured to generate a value for each selected activity metric and at block 1021, output these social activity metric values to the object scoring module 300. Each such metric value serves to measure user engagement with the news story on social media, for example, how many shares, tweets and other engagements the news story is attracting in a given period of time. For Facebook, these engagements can mean a share, like or comment; for Twitter, a tweet or retweet of a link; and for LinkedIn, a share of the content. In at least one embodiment the metric can be an aggregate engagement metric for different social media metrics, for example, a value that aggregates shares, comments, tweets, likes or other engagements and sends a single value for the aggregated engagements. For example, a social network platform such as Facebook may configure its system to send an aggregate value for engagements with a story rather than separate values for shares, likes, comments, etc. on the story, in which case the activity measurement module can measure engagements with the aggregate engagement metric value.

Figure 2:
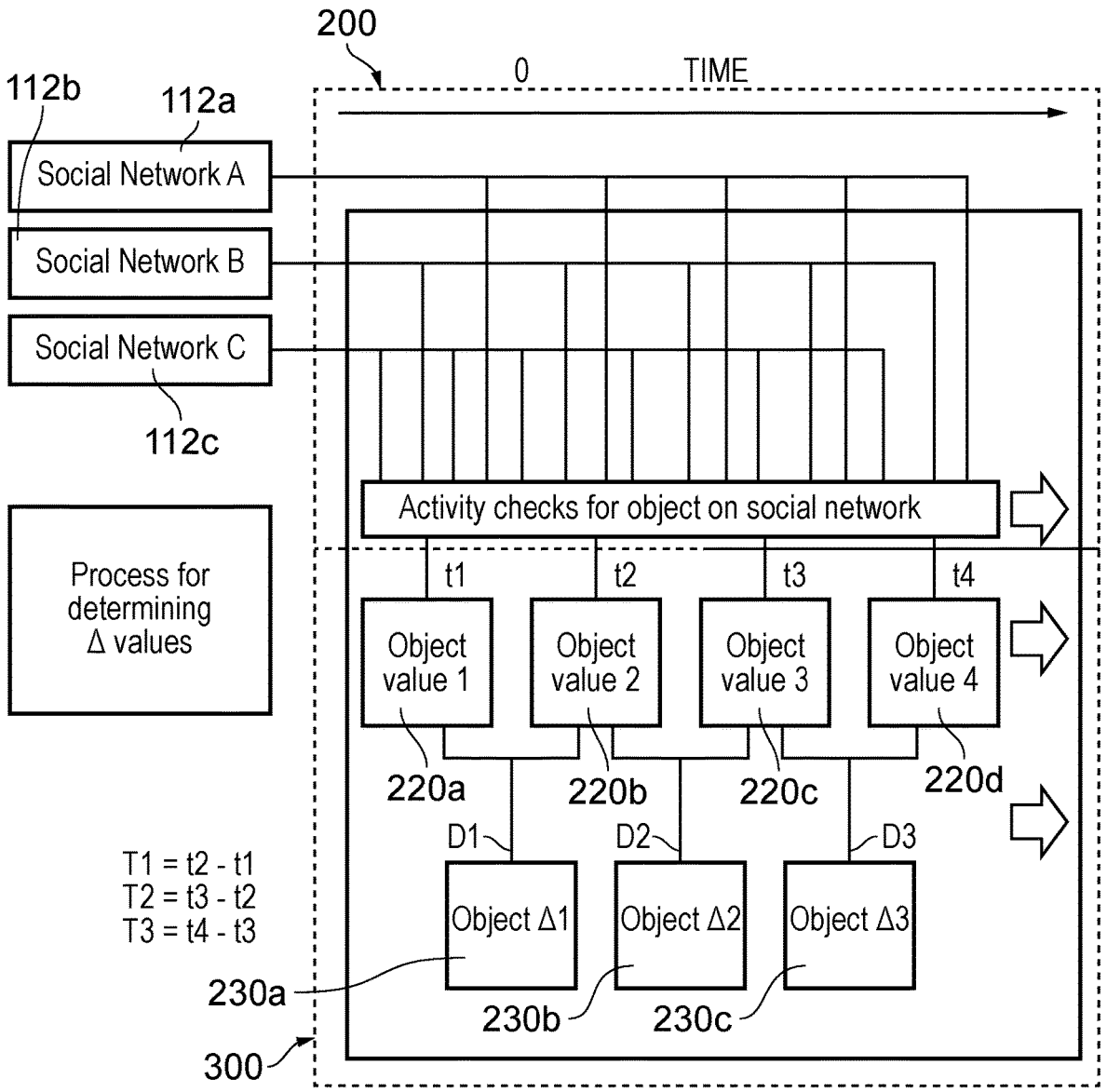
FIG. 2 is a diagram of an activity measurement module 200 in operative communication with an object scoring module 300 in accord with an embodiment.

FIG. 2 describes at least one embodiment of the activity measurement module 200 in operative communication with an object scoring module 300. In the embodiment, the activity measurement module 200 can include code that can be executed by a processor and that can be used to generate an activity metric value for social network activity of a digital content object. The activity measurement module 200 can be communicatively coupled to one or more social network databases 112*a*, 112*b*, and 112*c*. The system 100 can communicate with the social network databases 112*a*, 112*b*, and 112*c* via a web service application programming interface provided by the social network. For example, the system 100 can communicate with the social graph data provided by Facebook. The activity measurement module 200 can use this information from the social network databases 112*a*, 112*b*, and 112*c* to determine an activity metric value. In at least one embodiment, activity measurement is triggered by receipt of an external request from another module. Activity measurement is implemented by the activity measurement module 200 by formulating and sending a query to a social media platform 112*n*. On receipt of a reply to the query, it assigns a value to each metric based on the reply, and these values are then sent to the requesting module as a reply to the original external request.

In at least one embodiment, at block 1022, an object scoring module 300 is configured to generate an object score for each digital content object based on the activity metric values for the digital object. For example, in FIG. 1 the object scoring module 300 is a story scoring module 300 configured to score each monitored digital news story object for its social media impact on social media platforms, such as Facebook, Twitter, and LinkedIn. In at least one embodiment, at block 1024, the scores are then compared to generate and output a story ranking list. The story scores are based on a value of one or more social media activity metrics. The story score shows to what extent the news story has attracted social engagement, over any given period of time, which can be very current and short term, or over the medium term, long term or historically.

In one implementation, the story score is based on a single sample of the relevant social media activity metrics. In other words, the story score is based on measuring the relevant metrics, e.g. numbers of tweets and retweets, over a given period of time, e.g. the last 36 hours. Another option is to base the story score on a comparison of two samples of the relevant social media activity taken over two periods of time, e.g. the last 24 hours and the 24 hours prior to that. The story score then looks at changes in each of the metrics between these two time periods. This is the story scoring scheme described in U.S. Pat. No. 9,342,802 entitled System and Method of Tracking Rate of Change of Social Network Activity Associated with a Digital Object, the entire contents of which are incorporated herein by reference. A further option would be to base the story score on rate of change of the social media activity metric over at least three defined periods of time. Still more sophisticated story scoring may be based on curve fitting and extrapolation to activity versus time graphs created by plotting a social media activity metric over time, e.g. by frequent sampling of social media activity over many recent time periods to obtain the data points. In summary, the story score can be based on size, change, rate of change, or curve fitting of one or more social media activity metrics, which may be respectively termed: social weight; social velocity; social acceleration; or social interpolation.

In at least one embodiment, the story scoring module 300 is in operative communication with the parsing module 120. At block 1022, the object scoring module is configured to generate an object score for each digital content object based on the activity value metrics for the digital content object. For example, using the output from the parsing module 120 at block 1014 and the output from the activity measuring module 200, the object scoring module compiles a list of news stories to be compared, which can be category dependent.

For each news story that is in the batch of news stories to be compared, the story scoring module 300 requests values of activity metrics of specified social media platforms from the activity measurement module 200. The social media platforms identified in the request can be category-specific, e.g. if the subject matter category is "business" then the request may specify LinkedIn as the, or one of the, social media platforms. A single request can be sent to the activity metric measurement module 200 for all news stories in the batch, or individual requests, one for each news story object. On receipt of the activity metric values, the story scoring module then determines a story score for each news story, in which the story score is based on the values of the social media activity metrics associated with that news story which it receives from the activity metric measurement module.

In an embodiment, the story score can be determined by applying one or more pre-defined formulas that will give different weightings to different factors, in which the weightings can emphasize or de-emphasize factors such as:

- The social media platform
  - (e.g. more weight to LinkedIn for stories with a business category)
  - (e.g. more weight to Twitter for celebrity stories)
  - (e.g. more weight to Facebook for local community stories)
- The geographic origin of the news story source
  - (e.g. more weight is given to a specific country)
- Time of publication
  - (e.g. recent stories given more weight)
- Different weightings per social media activity on a single social media platform
  - (e.g. different weightings for shares, likes, and comments in Facebook)
  - (e.g. different weightings for tweets and re-tweets in Twitter)

Statistical normalization can be used to achieve a weighting between the different values that contribute to the overall score.

In at least one embodiment, the object score is based on a single sample of the relevant social media activity metrics. In other words, the object score 220 is based on the activity values from the activity measurement module 200 as described above, e.g. numbers of tweets and retweets, over a given period of time, e.g. the last 36 hours.

For example, in one embodiment of the system 100, an object score 220 for a digital content object can be based on an "OverAllScore" that is determined as shown below:

OverAllScore=(FaceBookCommentsScore*0.18)+(FaceBookSharesScore*0.37)+(FaceBook-LikesScore*0.11)+(LinkedInSharesScore*0.33)+(TweetCountScore*0.01).

As shown above, some social networks can be weighted more than others, and some interactions can be weighted more than others. For example, the posting of a link on Facebook can be weighted ten times more than another type of social network interaction, the mentioning of a link in a Tweet can be weighted five times more than another form of social network interaction, a Facebook "like" or recommendation can be weighted four times more than another form of interaction, the sharing of a link on LinkedIn can be weighted fifteen times more than another form of interaction, a Facebook comment can be weighted two times more than another form of interaction, and the like.

In at least one embodiment, the system 100 can repeatedly measure the object score values over time, thus determining multiple values for object scores 220*a*, 220*b*, 220*c*, and 220*d*. The time period between each measurement can vary. These time periods can be set by a system administrator or can result from the length of time associated with the system's processes. In some instances, the time period can be as short as can be achieved using the amount of computing power contained in the system 100. A time period can be very short (seconds) or longer (hours). The time period can extend to days or lengthier periods for some digital object types or sources. The time period assigned to some objects can differ depending on the level of activity associated with the objects. Objects associated with higher levels of social network activity can be checked more frequently, possibly resulting in shorter periods of measurement.

In an embodiment, the time period can also be measured and tracked by the system 100. For each digital object, the system 100 can then determine the change in social network activity since the previous time the system 100 obtained activity values and calculated object score values 220*a*, 220*b*, 220*c*, and 220*d* from social network activity, and the length of time that has elapsed between each measurement. This information can be stored in a digital database or databases 103, linking each digital object with its associated categories, associated parsed information (such as text, images, and other information), measurements of social network activity relating to the objects, the timing of these measurements, the differences in time between these measurements, object score values derived from these measurements, and comparisons of changes in the score values of the object scores derived from these measurements.

For example, the object score can also be based on object delta values, e.g., on a comparison of two samples of the relevant social media activity taken over two or more periods of time, e.g. the last 24 hours and the 24 hours prior to that last 24 hours. The object score then looks at changes in each of the metrics between these two time periods.

For example, as shown in FIG. 2, the system 100 can check the change in social network activity over time for a given digital object. The change in activity can be calculated by determining the level of activity at sequential points in time, such as, t1, t2, t3, and t4. A recording of an object score value can occur between a difference in time or a time period T. The difference in time or the time period T can be calculated based on:

$$T1=t2-t1$$

$$T2=t3-t2$$

$$T3=t4-t3$$

The levels of activity at each time, t1, t2, t3 and t4 can be recorded as object score values, 220*a*, 220*b*, 220*c*, and 220*d*. For example, at time t1, an object score value 220*a* can be recorded; at time t2, an object score value 220*b* can be recorded; at time t3, an object value 220*c* score can be recorded; and at time t4, an object score value 220*d* can be recorded. A difference D between each object score value, such as 220*a*, 220*b*, 220*c*, and 220*d*, can represent the total change in social network activity. The difference D can be calculated based on:

$D1$=object value 220$b$ at time $t2$−object value 220$a$ at time $t1$ $D2$=object value 220$c$ at time $t3$−object value 200$b$ at time $t2$ $D3$=object value 220$d$ at time $t4$−object value 220$c$ at time $t3$ Using these object score values, an object Δ value, such as 230*a*, 230*b*, and 230*c*, representing the change of activity associated with the digital object, can be derived based on:

Object Δ1 230$a$=$D1/T1$

Object Δ2 230$b$=$D1/T2$

Object Δ3 230$c$=$D3/T3$

Where: T1, T2, T3=variable time periods

D1, D2, D3=differences in social network activity over each variable time period T1, T2, T3, respectively The object Δ value, such as 230*a*, 230*b*, and 230*c*, can change each time the system 100 gathers new object score values including new social network activity measurement values for an object. Hence, the speed of "spread" (or additional social network activity) of the object can be periodically derived and recorded in the system 100. The object score value data based on object score values 220*a*, 220*b*, 220*c* can be either weighted using variables, normalized in relation to other data, or otherwise subjected to changes before the difference D between each measurement is calculated. Similarly, the difference D between each measurement can be either weighted using variables, normalized in relation to other data, or otherwise subjected to changes before the change of activity based on object Δ values 230*a*, 230*b*, 230*c* is derived.

Figure 3:
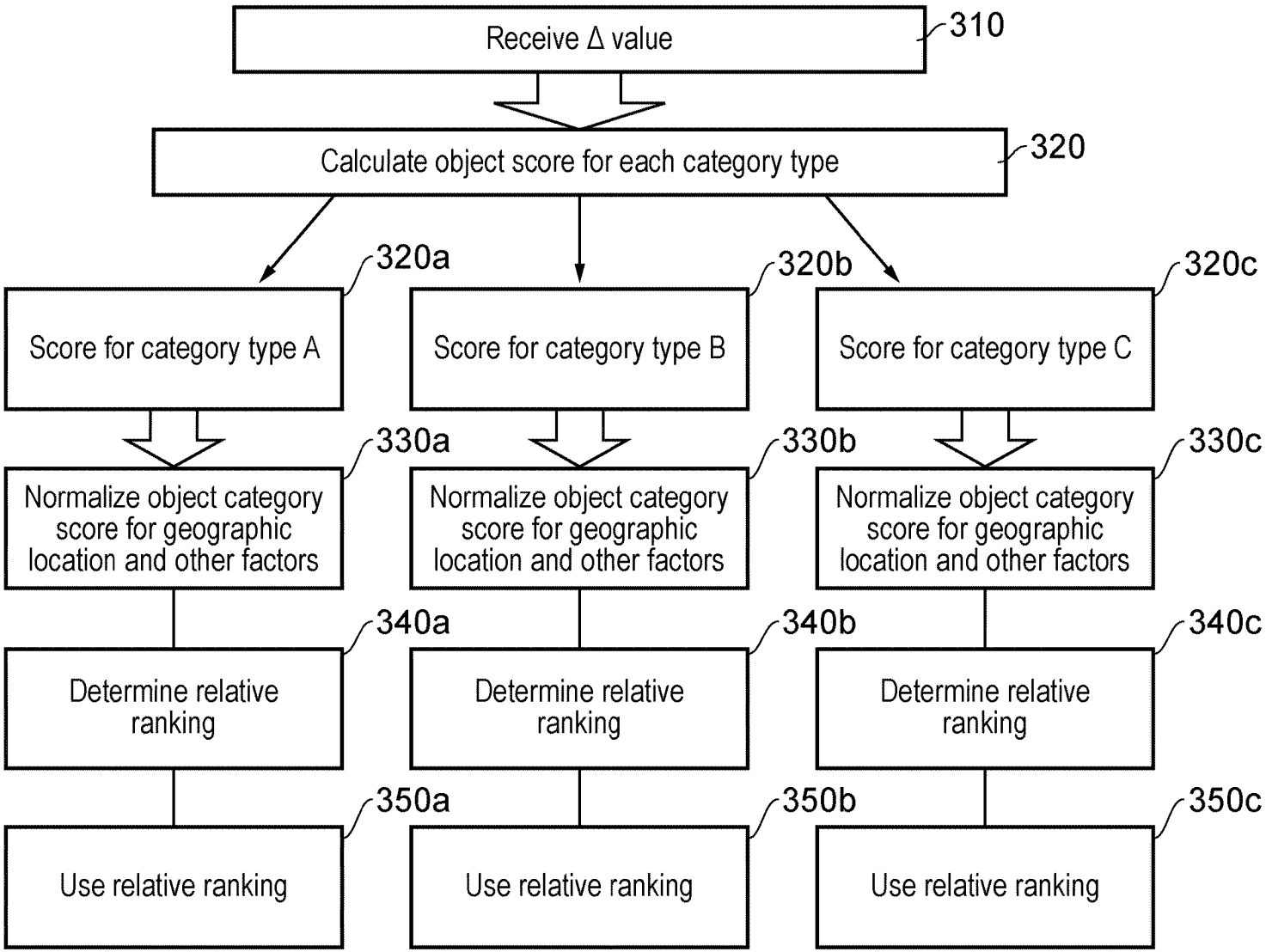
FIG. 3 is a flow chart showing a process of using object Δ values in social network activity to rank objects in accord with an embodiment.

In at least one embodiment, at block 1024, the scoring module 300 can also generate a digital content object ranking. For example, in at least one embodiment, the digital content objects can be ranked using the object Δ values, such as 230*a*, 230*b*, and 230*c*, over time generated by measuring the change in social network activity and other data. FIG. 3 shows a process of using object Δ values in social network activity to rank objects in accordance with an embodiment. The ranking can be generated at intervals T, or at other intervals that depend on the amount of resources available to the tracking module 101, the activity measurement module 200, scoring module 300 or other modules in the system 100. In one construction of the scoring module 300, the ranking can be dynamically refreshed in a category as new Δ values are gathered for each digital object in the category, and for new digital objects within the category. The Δ value for each object can be combined with other variables to provide an object score 320 for the object. The other variables can include a total time passed since the discovery of the object by the system 100, a time at which measurement of the social activities took place, a time at which the object was created, and other variables. The variables can be adjusted to give greater prominence or higher scores to more recently created or discovered objects. The object score for an object can also be adjusted for the object in each category type assigned to it by the categorization module 104. For example, in category type A, the object can be given an object score 320*a*; in category type B the object can be given an object score 320*b*; and in category type C the object can be given an object score 320*c*. The scores 320*a*, 320*b*, and 320*c* can be stored with the rank of each category type A, B, and C.

Additional information can then be added to these category object scores 320*a*, 320*b*, and 320*c* to provide additional weight to the score associated with certain digital objects in relation to the score associated with other digital objects, depending on the objects' type, geographic source, time of publication, or other data. Among others, a process of statistical normalization 330 can be used to achieve a weighting between object scores. This allows the system 100 to allocate additional weight to digital content objects from sources 102*a* or 102*b* that are geographically closer or are otherwise of interest to the end user of the system 100. Thus, for example, for end users of the system 100 in the UK accessing online news stories, social network activity associated with those news stories that are produced in the UK or relate to the UK can be given a higher weighting. For example, in one construction of the system 100, for an end user in Ireland, a story from the UK can be given a lower weighting than a story from Ireland. The process of statistical normalization of scores from sets of data with differing distributions is familiar to programmers of ordinary skill in the art.

Alternatively, the object score 320 can be determined for each object using data from multiple measurements of social network activity values. In one embodiment, such multiple values can be used to degrade the score for a digital object over time.

$$\text{Score}=220a(p)+220b(q)+220c(r)+\ldots 220n(s)$$

$$T1+T2+T3+\ldots Tn$$

Where:

Score=The score used for ranking a given digital object.

220*a*=Social network activity at time t1

220*b*=Social network activity at time t2

220*c*=Social network activity at time t3

220*n*=Social network activity at time to s, r, q and p are numbers where s>r>q>p $$T1=t2-t1, T2=t3-t2, T3=t4-t3,$$

$$Tn=t(n+1)-tn$$

In at least one embodiment, a normalized object category score 330*a*, 330*b*, and 330*c* can be applied to each digital object for each category A, B, and C, respectively. Using the normalized object category score 330*a*, 330*b*, and 330*c*, the objects can be ranked according to their relative weighted scores to determine a relative ranking 340*a*, 340*b*, and 340*c*. The relative ranking 340*a*, 340*b*, and 340*c* can then be used to provide a relative ranking 350*a*, 350*b*, and 350*c*. The relative ranking 350*a*, 350*b*, and 350*c* can then be used to generate a table, display, or other information to convey the rank of one or more digital content objects. The same object can earn different relative scores in each subject category, represented by the numerals 340*a*, 340*b*, and 340*c*, resulting in variable rankings, 350*a*, 350*b*, and 350*c*.

An example of digital content object scoring scheme that can be employed with embodiments as described herein is further described in U.S. Pat. No. 9,342,802 entitled System and Method of Tracking Rate of Change of Social Network Activity Associated with a Digital Object, the entirety of which is incorporated by reference herein. A further option would be to base the story score on rate of change of the social media activity metric over at least three defined periods of time. Still more sophisticated story scoring can be based on curve fitting and extrapolation to activity versus time graphs created by plotting a social media activity metric over time, for example, by frequent sampling of social media activity over many recent time periods to obtain the data points.

In at least one embodiment, at block 1026, the object scoring module is configured to output a digital content object ranking to the user interface. In another embodiment, at block 1028, the object scoring module can also be configured to output the digital content object ranking to the entity ranking module.

For example, in at least one embodiment, the entity scoring module 400 is in operative communication with the story scoring module 300, from which the entity scoring module 400 receives as input the list of news stories including story scores to be analyzed for named entities. In an embodiment, the story scoring module 300 can also provide the entity scoring module 400 with the story ranking list. The entity scoring module 400 is also in operative communication with the parsing module 120 from which it receives the digital content object file 105 and/or the summary file 107 or both containing the natural language element for each of the news stories to be analyzed by the NER classifier. For purposes of illustration, the embodiment of the entity scoring module 400 is shown and described as performing NER analysis on only summary files 107, however the system can perform AI natural language processing including NER analysis on each of the full content of the digital content objects, parsed or partial text elements for each of the digital content objects, or both.

As will be appreciated, in embodiments databases 103, 503, 401 and data therein, though shown in particular modules, can be shared and accessed across components and modules of the system and need not be located in specific components for access to the data for, among other things, story scoring and entity ranking as described herein. For example, databases 103, 503, 401 can be accessed by the data collection module 10 and its component modules and the trending unit 20 and its component modules. The logical architecture and operational flows disclosed herein are illustrated to describe embodiments in an exemplary manner without limitations to a specific architecture, as skilled artisans may modify architecture design when, for instance, implementing the teachings of the present disclosure into their own systems.

Returning to FIG. 1, the entity scoring module 400 is configured to extract named entities that appear in the batch of tracked news stories and then calculate an entity score by aggregating the engagement that news stories which mention each named entity are attracting on social media. In turn, the entity scores are then sorted to provide an entity ranking list suitable for output. All entities are extracted from a new story, e.g. from its summary 107, and the extracted entity data 403 is stored for later use in a database 401 so that filters and analysis can be applied to the extracted and stored entity data 403. In at least one embodiment, the system is configured store the extracted entities in a search engine database. An exemplary search engine is ElasticSearch from Elastic Search BV, Amsterdam, although as will be appreciated, other search engines or searchable databases 401 can be employed.

The entity scoring module 400 is configured to perform an NER analysis on natural language elements of content in digital content object and data derived therefrom. In at least one embodiment, at block 1030, the entity scoring module 400 includes an NER classifier configured to perform NER analysis: extract those named entities that appear in each digital content object's natural language element. For example, the entity scoring module 400 includes an NER classifier configured to perform NER analysis of digital content object summary file 107. As will be appreciated, the entity scoring module 400 can be configured to perform an NER analysis on some or all of the natural language elements of a digital content object, for example a summary file 107 of a news story and the body or main content of a news story file 105. In another embodiment, the entity scoring module 400 can be configured to extracting named entities only from a summary file 107 of a digital content object, for example, the summary file 107 of a news story or abstract of a technical paper. One exemplary advantage of this configuration is that NER analysis of news summaries and abstract typically include the central entities mentioned in the story, providing that the summary and abstract gives an accurate reflection of the story.

In at least one embodiment, the entity scoring module 400 can use a NER code classifier such as the publicly available MITIE (MIT Information Extraction) library (https://github.com/mit-nlp/MITIE). The MITIE library NER classifier comprises a model that is available in pre-trained form, e.g. pre-trained in English.

The English NER model has been trained based on data from:

- the English Gigaword news corpus;
- the CoNLL (Conference on Computational Natural Language Learning)-2003 named entity recognition task; and
- ACE (Automatic Content Extraction) data from NIST (National Institute of Standards and Technology).

As will be appreciated, any library code that supports NER can be used for embodiments including an NER classifier. For example, NER code available from ClearForest Corp. of Waltham, Mass., StanfordCoreNLP <http://nlp.stanford.edu/software/CRF-NER.shtml>; and Natural Language Toolkit (NLTK) <http://www.nltk.org/>.

At block 1036, the entity scoring module is also programmed to calculate an entity score that aggregates the story scores of those digital content objects in which that named entity appears. At block 1038 entity scoring module is configured to and sort the entity scores to generate an entity ranking list based on the entity scores. At block 1039 the system is configured output the entity ranking, for example, to a user interface.

A description of an entity scoring process is further described in U.S. Provisional Patent Application 62/368,668 entitled System and Method for Identifying and Ranking Trending Named Entities in Digital Content Object, filed Jul. 29, 2016, the entirety of which is incorporated in its entirety by reference hereby.

Described herein are embodiments of a system and methods for optimized bespoke alerting for digital content objects. In various embodiments, the system is configured to allow a user to configure one or more panel specifications to identify and optimize alert notifications for digital content objects. The configuration of a digital content object panel specification to define characteristics of digital content objects of interest allows the system to understand the context in which the user wants to be alerted. The panel specification is referred to as "a panel" or "panel specification" herein. Once this context is defined, a batch of digital content objects with various lifetime evolutions can be analysed in terms of a selected variable by fitting the variable to a distribution function in order to parameterize the distribution function. With a parameterized distribution function it is then possible to assess a current digital content object through the same variable. That is the parameterized distribution function allows any digital content object to be scored against the variable of the distribution function and from that score it can be directly determined where the digital content object lies in the distribution, i.e. the probability that the current score would be achieved by a comparable digital content object. If the variable measures social media impact, then the current level of social impact of a current digital content object is a measure of how much impact that digital content object is having at the current moment in time.

Figure 5:
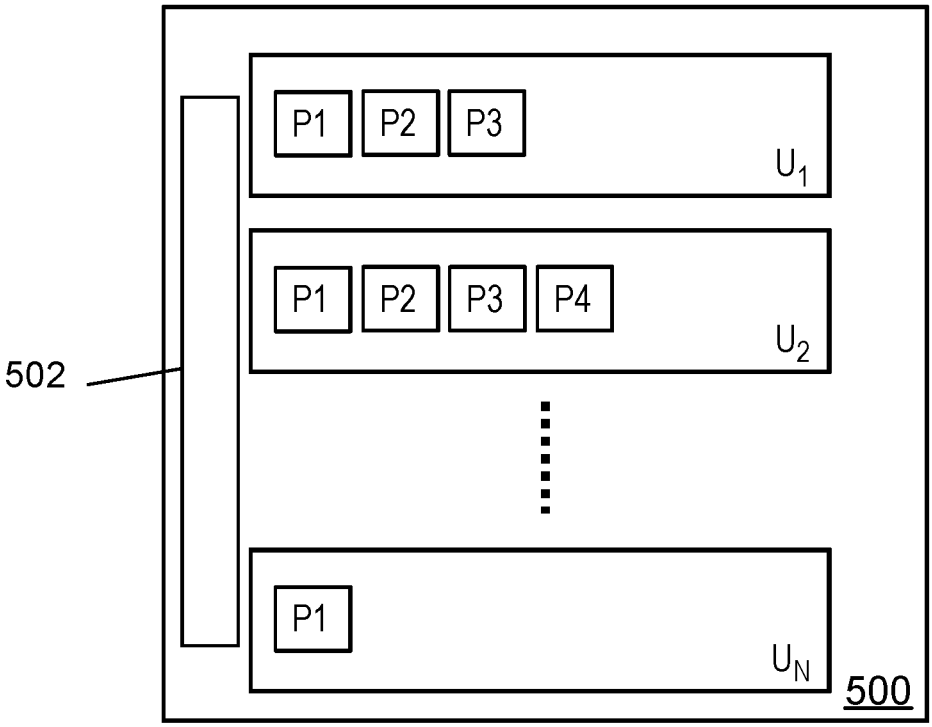
FIG. 5 shows the alerting module of FIG. 1.

In an embodiment, the system is configured to allow a user to configure a panel specification that the system uses to optimize the alerting module 500 to provide targeted alerting to the user. FIG. 5 shows the alerting module 500 of FIG. 1 and FIG. 11 in more detail. For each of 'N' users 'U', the alerting module 500 stores panel specifications P1, P2 . . . as defined by each user (or for each user). Each panel constitutes a specification of a set of criteria which collectively define a search definition. The role of each panel is therefore to select a number of digital content objects from among a large number of digital content objects of the same type (e.g. news stories) according to those which match the search definition to obtain a batch of digital content objects as a batch. The alerting module 500 is thus configured to access database 103 with the digital content objects tracked by the tracking module 101 and identify that digital content objects which meet the criteria specified in each of the different active panels are captured from the digital content object sources 102*n*. The alerting module comprises an alerting analysis tool 502 including a data analyzer configured to analyze the digital content objects to provide customized ongoing alerts for tracked digital content objects.

Figure 6:
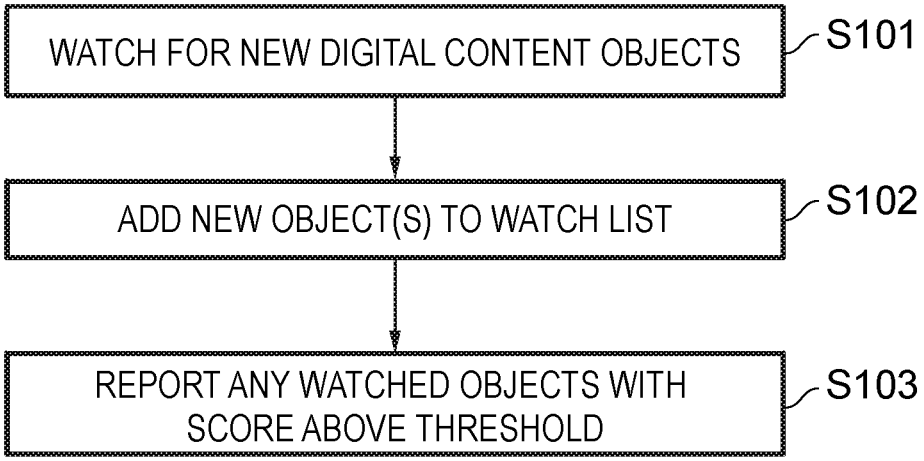
FIG. 6 is a flow chart illustrating an alerting process for the alerting module in accord with an embodiment.

FIG. 6 is a flow chart of an embodiment that illustrates how the alerting module 500 manages a single active panel specification. The alerting module 500 is configured to watch for new digital content objects, tracks as-yet not alerted digital content objects matching a panel specification and selectively sends alerts to the user interface to whom the panel relates.

At block S101, the alerting module watches for new digital content objects that meet the panel specification. This is done via the tracking module 101, which tracks digital content objects 105 as described herein and stores them in a database 103. The alerting module then runs the panel specification of active panels 500 on the database 103 to identify digital content objects meeting the panel specification, which are then added to a database 503 of panel tracking lists 505 tracked for each active panel. In various embodiments, the alerting module can have direct access to the database 103 of digital content objects 105 tracked by the tracking module 101 or the panel specification of active panels can be provided to the tracking module from the alerting module 500. In an embodiment, panel tracking lists 505 of digital content objects 105 tracked for panels can be stored as digital content object files or digital content object summary files in a database 503 which can be in operative communication with the alerting module 500 and the tracking module 101 as described herein.

At block S102, any new digital content objects which are identified in webspace from digital content object sources 102*n* by the tracking module 101 as described herein are added to a panel tracking list 505 of digital content objects to be tracked for that specific panel when the digital content object meets the panel specification.

Figure 7:
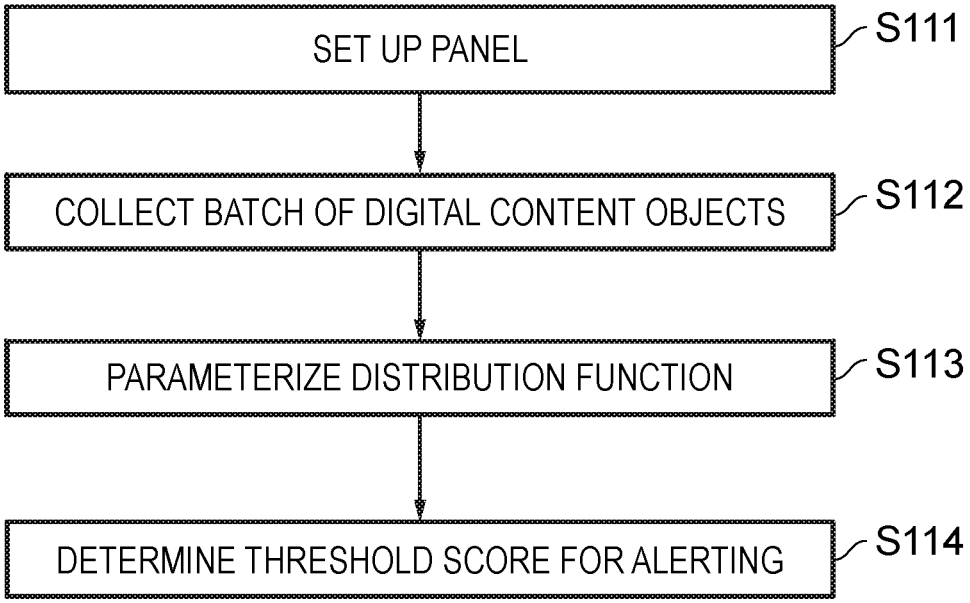
FIG. 7 is a flow chart illustrating a process for parameterizing a statistical model in accord with an embodiment.

At block S103, the alerting module 500 then determines on an ongoing basis, and taking account of a variable being used as the basis for scoring whether to alert the user of the tracked digital content objects 505. The embodiment is described using the variable of social velocity, however, the variable can be selected from a number of variables, for example, social weight, social acceleration, particular engagements (e.g, comments, shares, likes, tweets), number of engagements, entity ranking, and so on. In an embodiment, a social velocity story score is provided by the object scoring module 300, which is used to determine whether to alert the user associated with the panel about any one of the tracked digital objects. If, for a particular digital content object being tracked, the current score of the variable is greater than a threshold determined by the system for the panel as described below with respect to FIG. 7, then the user is alerted to that digital content object. At the same time, the alerted digital content object is identified as having been alerted to the user, so that the user is not again alerted about the same digital content object. In an embodiment, the just-alerted digital content object can be retained in the tracking list 505, but tagged so it is not re-reported. Alternatively, the just-alerted digital content object may be removed from the tracking list and added to a separate list of alerted digital content objects 506 for the panel, and the system configured not to send alerts for any digital content objects in the list of alerted digital context objects 506. FIG. 7 is a flow chart illustrating an embodiment in which a statistical model is parameterized based on analysis of a batch of digital content objects conforming to a panel specification. As described above in relation to FIG. 15, a user sets up a panel with a configurator. Setting up a panel is the starting point for parameterizing a statistical model that the system is configured to employ to determine whether to alert in Step S103 of FIG. 6 described above.

Figure 15:
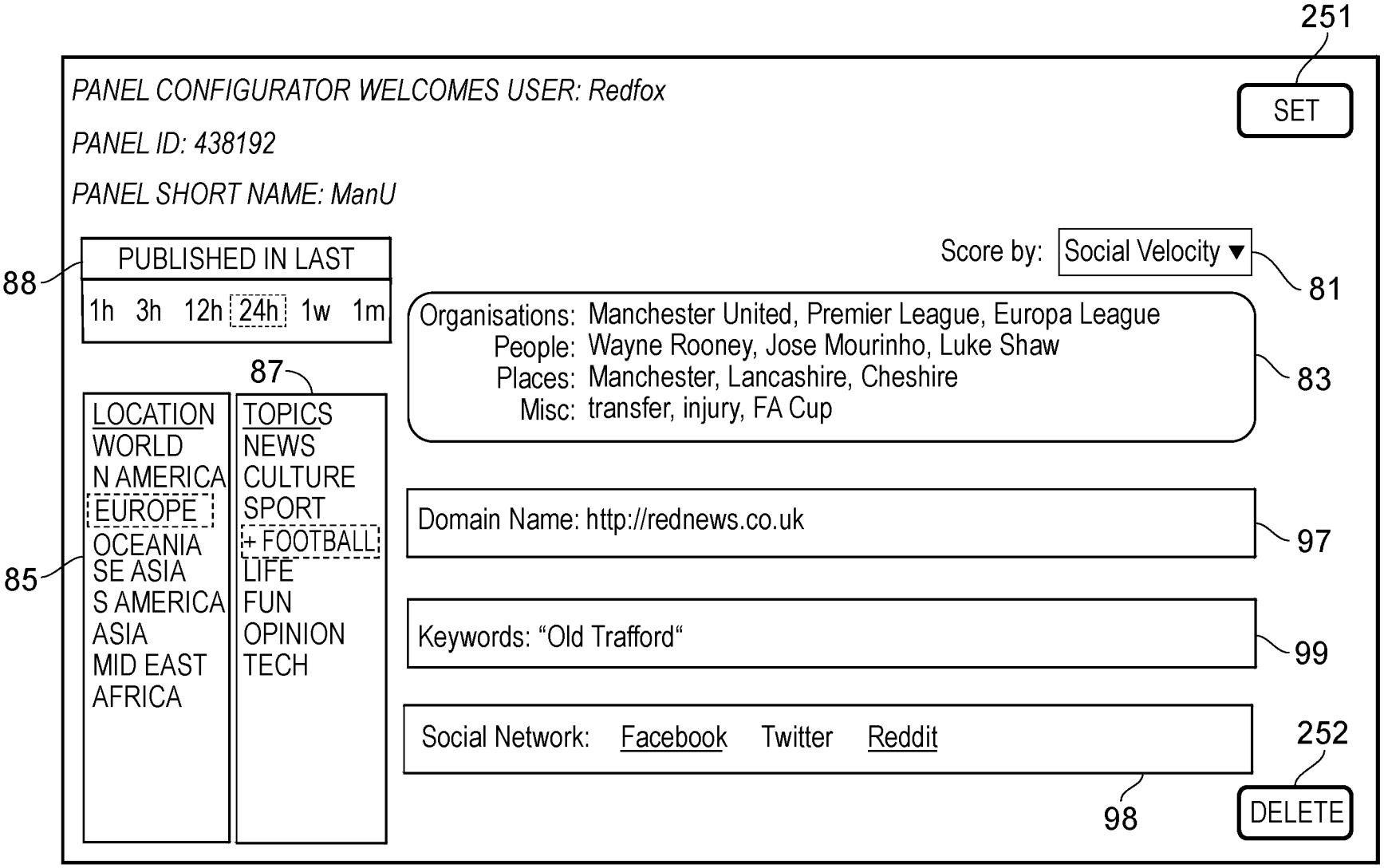
FIG. 15 shows a panel configurator user in accord with an embodiment.

At block S111, the user sets up a panel as described below with reference to the interface illustrated at FIG. 15.

At block S112, the alerting module 500, applies the panel specification to the database 103 of digital content objects 105 and identifies a statistically valid number of digital content objects 105 which meet the panel specification, i.e. a batch of digital content objects. The alerting module 500 is configured to access the database of digital content objects 103 tracked by the tracking module 101 and apply the panel specification to identify a batch digital content objects meeting the panel specification parameters as described herein.

At block S113, an alerting analysis tool 502 includes a data analyser configured to analyse the batch of digital content objects to determine the parameters of a statistical model which is fitted to the digital content objects, an embodiment of which is described with in more detail with respect to FIG. 7. With a parameterized distribution function it is then possible to assess a current digital content object through the same variable. That is the parameterized distribution function allows any digital content object to be scored against the variable of the distribution function and from that score it can be directly determined where the digital content object lies in the distribution, i.e. the probability that the current score would be achieved by a comparable digital content object. If the variable measures social media impact, then the current level of social impact of a current digital content object is a measure of how much impact that digital content object is having at the current moment in time.

The statistical model provides a distribution function where the distribution of the score is a function of a variable selected by the user in the panel to be used as the basis for scoring. In the specific example described herein, the variable is peak social velocity and the score is the value of peak social velocity attained by the digital content object during its lifetime (to date). The statistical model is fixed in some embodiments. In other embodiments, the alerting module 500 may choose between multiple available possible statistical models for probability distribution based on the shape of the real distribution function for the batch of digital content objects being analyzed. For example, the statistical model can be an exponential distribution, a vector space distribution, or a Weibull distribution. Once the "experimental data" constituted by the scores from the batch of digital content objects has been fitted to the chosen distribution function, the distribution function has values for all its parameters. Alerting can then be done based on comparing the current impact level, i.e. score, against the impacts of a comparable group as defined by the parameterized distribution function. An alert threshold can thus be set in terms of the probability that the current score is achieved by comparable digital content objects.

The parameterized distribution function can then be used as a basis for deciding whether to alert, since the distribution function can identify a good score for the particular panel as represented by the batch. Thus, what constitutes a good score can be different from panel to panel, and the alerting module is configured to identify and optimize alerting for each panel.

In an embodiment alert threshold can adjusted based on a comparison between actual At block S114, the system determines a panel-specific threshold score for alerting from the parameterized distribution function for the specific panel. An exemplary determination of a "good score" for a threshold (e.g.: a "big story" where the digital content object is a news story) might be in terms of a percentage distribution: for example the top 1, 2, 3, 4 or 5% of scores. Other criteria can be included when defining the threshold of an alert-worthy score, such as, for example, how often a user wants to be alerted, which is described below.

Parameterisation can be continually updated as the batch of digital content objects which meet the panel specification evolves. In embodiment, the system can continually update the group of digital content objects matching the specification, and, based on the updated group, continually repeat determining a value of the variable for each of the digital content objects of the batch, fitting the values of the variable to the distribution function in order to determine updated parameter values for the distribution function; and determining the threshold value for alerting based on the updated parameterized distribution function. In this way, the threshold for alerting can be kept up-to-date, since it will always remain benchmarked against a representative recent group of comparable digital content objects.

The parameterisation is thus not only bespoke for each panel, but also can continuously recalculate the threshold based on the distribution to thereby revise what constitutes a good score over recent times based on real comparable data. Taking the example of social velocity, all the digital content objects which are in the batch which match the panel specification can have their social velocity score continually updated, so that the distribution function can be re-parameterized using up-to-date scores. For example, the score can be updated for a digital content object every time a new data point is obtained for that tracked digital content object, i.e. every time an event which affects the score is logged.

Figure 8:
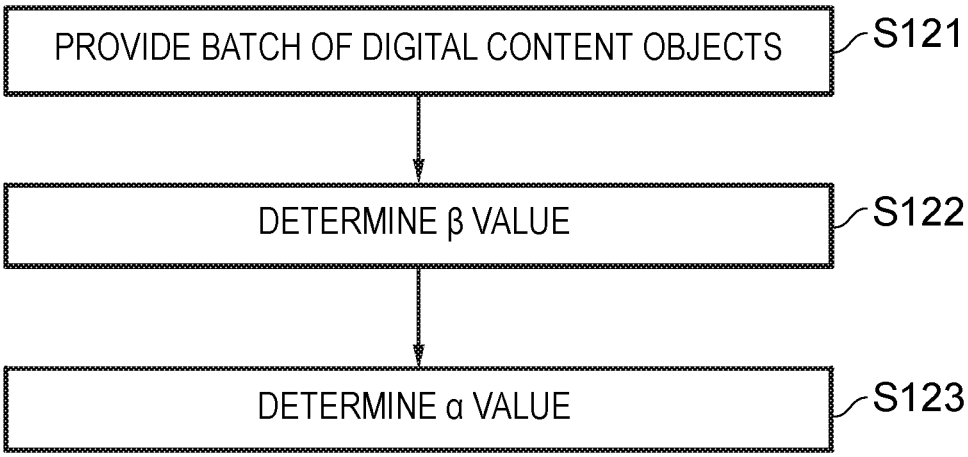
FIG. 8 is a flow chart showing an example of a parameterization process according to a 2-parameter Weibull distribution.

In an embodiment, the alerting module determines the threshold for the panel using a distribution function for parametrization. The alerting module 502 identifies digital content objects—stories—meeting a panel configuration with the variable for social velocity. FIG. 8 is a flow chart showing a specific example of parameterization according to a 2-parameter Weibull distribution function, which is:

$$f(x) = \frac{\beta}{\alpha}\left(\frac{x}{\alpha}\right)^{\beta-1} e^{-(x/\alpha)^{\beta}}$$

In the Weibull distribution, the random variable x is taken as peak social velocity. As noted herein, the random variable is the ordering metric that the user specified in the user interface during panel creation, for example peak social velocity (per the present example), entity ranking, total shares, or other criteria chosen by the user. The parameters to find values by fitting to the data are $\alpha$ and $\beta$, referred to as a scale parameter and a shape parameter respectively. Since the variable can be at least quasi-continuous, the points on the distribution function may be binned, for example within a range of the variable. Taking the example of a peak social velocity score lying in the range 0 to 1000, the batch may be binned into those digital content objects which have a peak score within a 10 point score interval, thereby yielding 100 points in the distribution.

Figure 9:
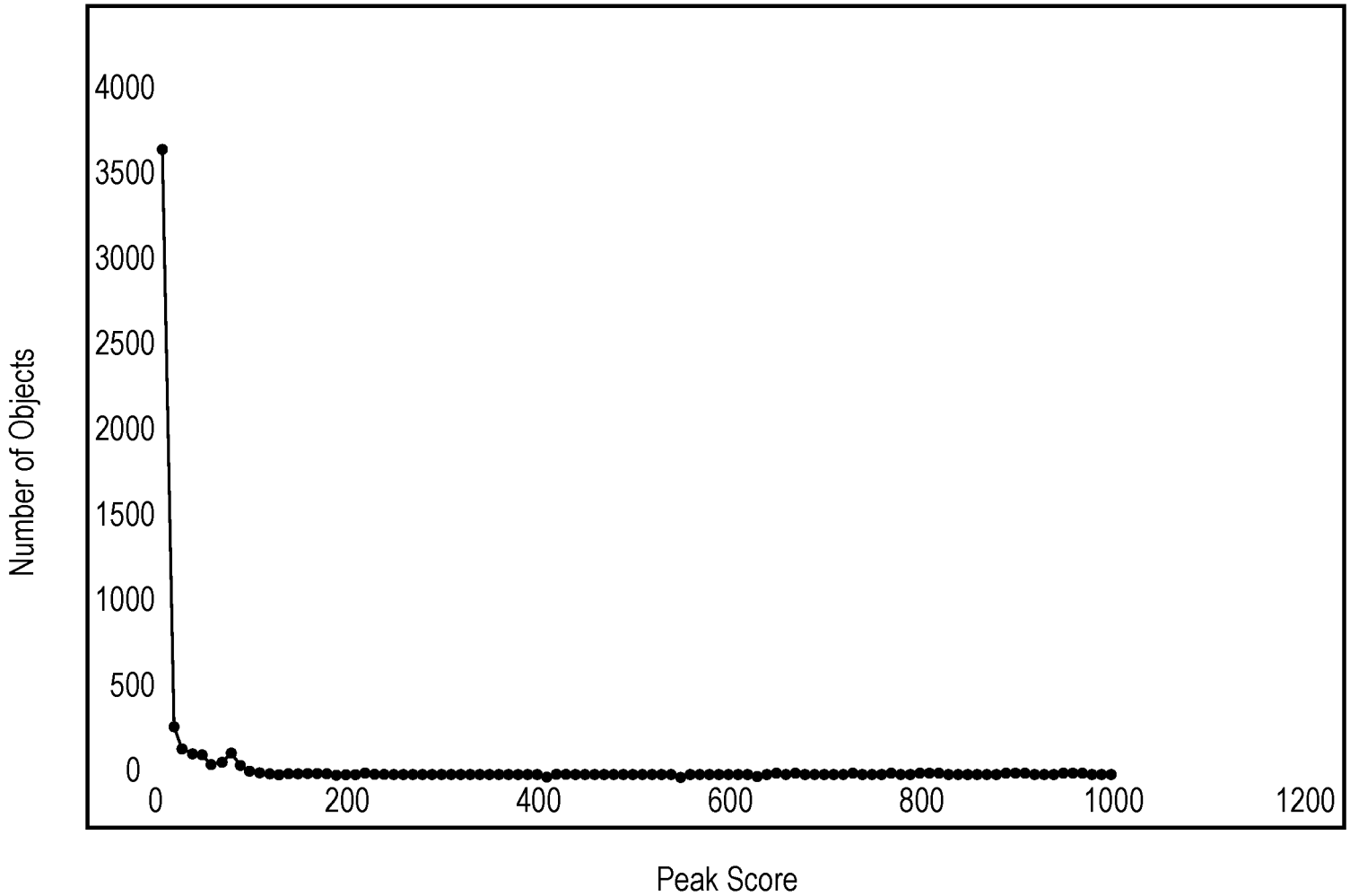
FIG. 9 is an exemplary probability distribution function in accord with an embodiment.

FIG. 9 is an example of a probability distribution function for a batch of digital content objects conforming to a panel specification in which the random variable is peak social velocity of a news story. A person skilled in the art will recognize that the distribution shown in FIG. 9 is indicative of an 'infant mortality' type distribution, i.e. with a value of the parameter $\beta<1$, by which the probability of a higher peak velocity score for a story decreases as the score gets higher (x). However, actual distributions for other batches based on peak social velocity of news stories can show a wide range of $\beta$ values, including static distributions $\beta=1$, where peak velocity scores are distributed evenly along the score range, and "aging" distributions $\beta>1$, where distributions of peak social velocity are higher scores.

At block S121, a batch of digital content objects is provided for fitting. As shown in FIG. 8, the panel parameters are applied to the database 103 of tracked digital content objects 105 to obtain a batch of digital content objects. The panel is run with peak social velocity scores being taken at random, that is, the panel is run without knowledge of the distribution shape.

At block S122, the shape parameter $\beta$ is determined according to the formula:

$$\hat{\beta} = \frac{1}{\dfrac{\sum_{i=1}^{N}\left(x_i^{\beta}\ln x_i - x_N^{\beta}\ln x_N\right)}{\sum_{i=1}^{N}\left(x_i^{\beta} - x_N^{\beta}\right)} - \dfrac{1}{N}\sum_{i=1}^{N}\ln x_i}$$

To obtain the $\beta$-value, the left-hand part of the denominator can be determined analytically and the right-hand part by iteration using the Newton-Raphson method.

At block S123, now that $\beta$ is known, the scale parameter $\alpha$ is determined with a maximum likelihood estimation according to the formula:

$$\hat{\alpha}^{\beta} = \frac{1}{N}\sum_{i=1}^{N}\left(x_i^{\beta} - x_N^{\beta}\right)$$

where $x_1>x_2>\ldots>x_N$, and these are the data points with the largest N values, there being more than N data points. The scale parameter gives the distribution for the shape of the scores for the digital content objects.

Once the parameters are determined from the random sample, the system can then determine an alert threshold as described at block S114. With the parameterized distribution function the system is configured to assess new digital content objects for the same variable. That is, the parameterized distribution function allows any digital content object to be scored against the variable of the distribution function, and from that score it can be directly determined where the digital content object lies in the distribution, i.e. the probability that the current score would be achieved by a comparable digital content object. For example, if a news story currently has a social velocity which is higher than 95% of comparable news stories, or equivalently only exceeded by 5% of comparable news stories, then it is known that this is a "big story." An alert threshold is thus set in terms of the probability that the current score is achieved by comparable digital content objects.

The system can be configured to adjust and optimize the alert threshold by applying the probability distribution using the user-selected variable. Thus, per the example of social velocity, the system is configured to identify for each panel the peak social velocity scores for each panel, and can thus determine and adjust alert thresholds based on the machine-learned knowledge of good scores in the panel parameters.

In an embodiment, the alert threshold can be adjusted over time to avoid alerting too frequently, based on an optimum or not-to-exceed frequency specified by the user who receives the alerts. This can be implemented by trying to match the frequency with which alerting takes place to the frequency specified by a user, or by trying to avoid exceeding the frequency specified by the user. In the latter case, the approach will allow for next to no alerts being generated, whereas in the former case if the frequency of alerts is too low, then the thresholds will be reduced to increase the alert rate.

Figure 10:
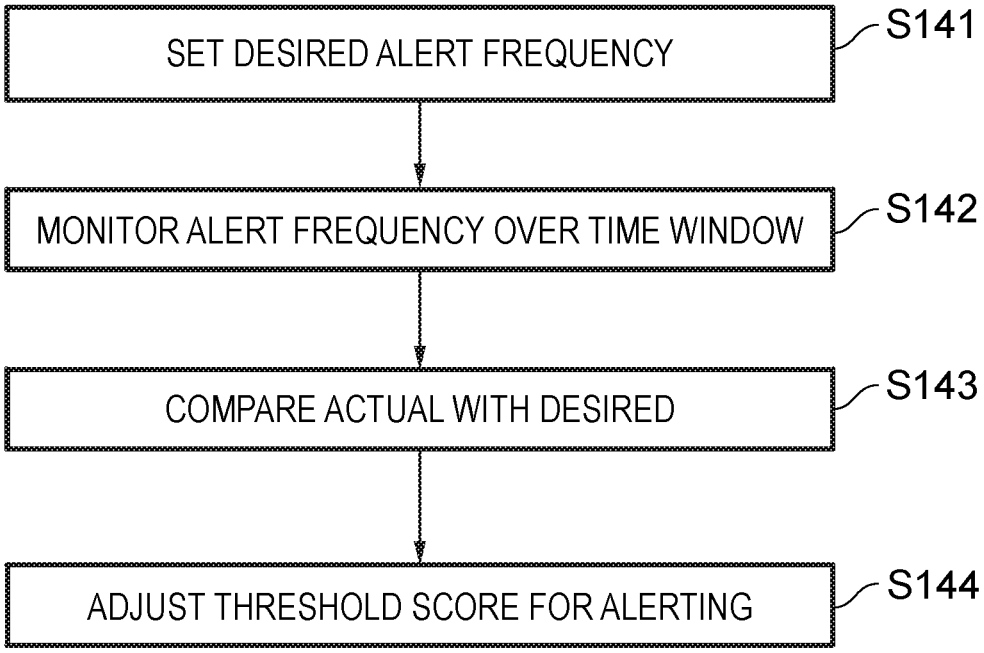
FIG. 10 is a flow chart illustrating a process for adjusting an alert threshold in accord with an embodiment.

FIG. 10 is an embodiment in which the alert threshold is adjusted based on a comparison between actual alert frequency and user-specified desired alert frequency.

At block S141, the user inputs his or her desired alert frequency. This may be on a per-panel basis or globally for the user for all his or her panels.

At block S142, the alerting to the user is monitored over a predetermined a time window, for example either 1 hour, 3 hours, 12 hours, 24 hours, 1 week, or 1 month, as selected using a user interface 30 as described herein. For example, the system can determine the initial alert threshold using a linear calculation for the alarm such as the user's inputted alert frequency divided by the total number of articles identified by the panel for given time period (e.g. a 24 hour period).

At block, the frequency of actual alerting is compared with the desired alert frequency as inputted by the user.

In At block, if the alerting is too frequent, then the panel threshold is increased, or multiple thresholds are increased in the case of a global approach to alert frequency across all active panels. If the alerting is below the desired frequency, then the alerting module can be configured to make no adjustment, or to decrease the threshold(s). That is the desired alert frequency may be interpreted as either: 'alert me no more than this frequency' or 'alert me this frequently'.

As shown in Table 3 below, an example of a user's current panel is set up with seven active panels. Each panel has values for the Weibull parameters α and β, the threshold score, and the alert frequency as defined by number of alerts per day.

TABLE 3

Example User with Seven Active Panels:

| Panel ID | Alert Threshold % | Alpha α | Beta β | Alert Frequency per day |
|---|---|---|---|---|
| 14 | 0.000032 | 40.699 | 0.6924 | 2 |
| 19 | 0.002880 | 34.885 | 0.5536 | 5 |
| 21 | 0.000184 | 27.614 | 0.7629 | 5 |
| 30 | 0.001742 | 97.939 | 0.6593 | 1 |
| 31 | 0.000648 | 43.705 | 0.5923 | 4 |
| 32 | 0.010681 | 67.552 | 0.8693 | 4 |
| 33 | 0.00005 | 92.334 | 0.7535 | 3 |

Illustrative Operating Environment

Figure 11:
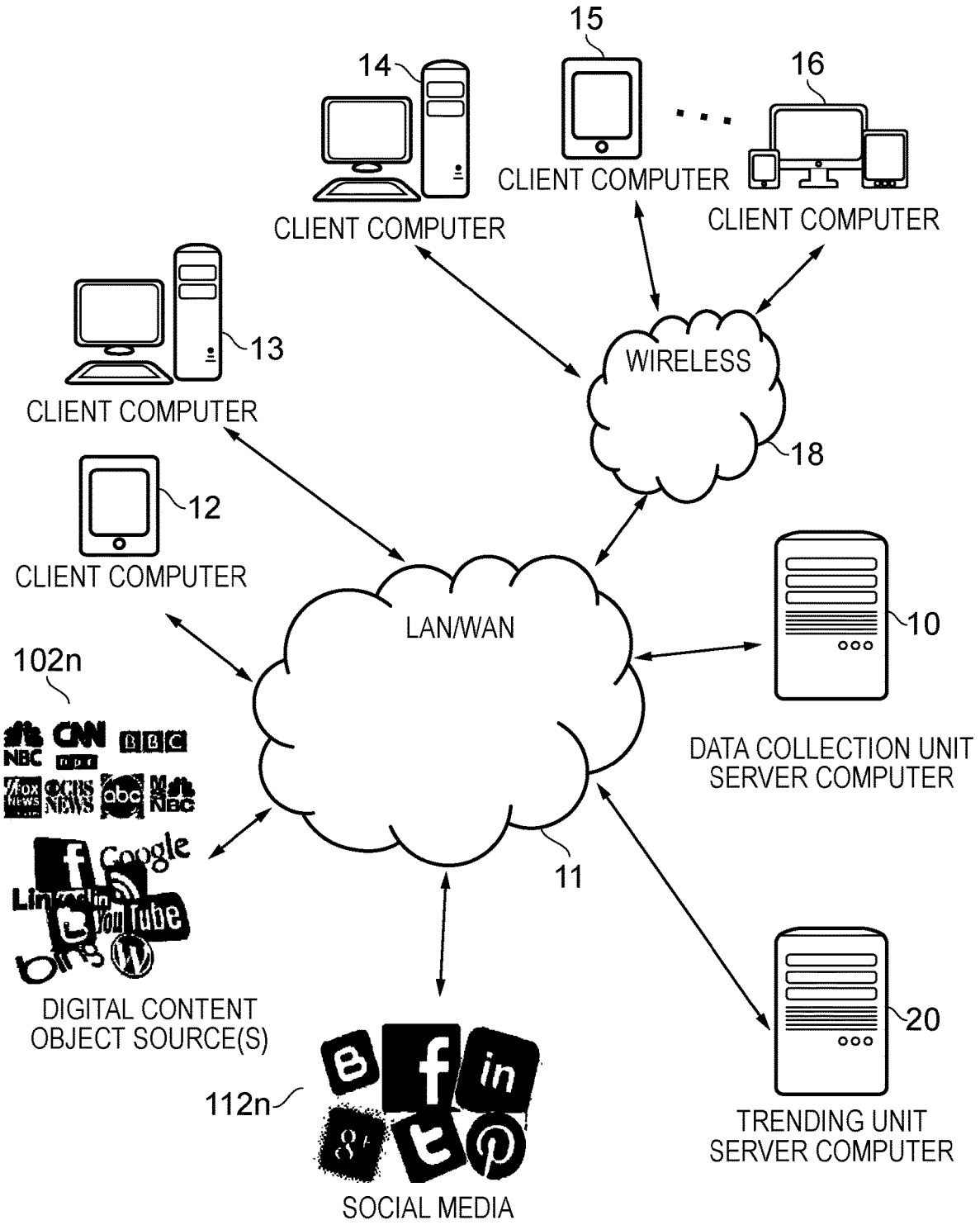
FIG. 11 shows an embodiment of an environment in which the present embodiments can be practiced.

FIG. 11 shows components of an embodiment of an environment 101 in which embodiments of the present disclosure can be practiced. Not all of the components may be required to practice the innovations, and variations in the arrangement and type of the components can be made without departing from the spirit or scope of the present disclosure. As shown, FIG. 11 includes local area networks (LANs)/wide area networks (WANs)—(network) 11, wireless network 18, client computers 12-16, Data Collection Unit Server Computer 10, Trending Unit Server Computer 20, Social Media Server Computer 112*n*, and Digital Content Object Source(s) Computer 102*n*.

At least one embodiment of client computers 12-16 is described in more detail below in conjunction with FIG. 10. In one embodiment, at least some of client computers 12-16 can operate over a wired and/or wireless network, such as networks 11 and/or 18. Generally, client computers 12-16 can include virtually any computer capable of communicating over a network to send and receive information, perform various online activities, offline actions, or the like. In one embodiment, one or more of client computers 12-16 can be configured to operate in a business or other entity to perform a variety of services for the business or other entity. For example, client computers 12-16 can be configured to operate as a web server or an account server. However, client computers 12-15 are not constrained to these services and can also be employed, for example, as an end-user computing node, in other embodiments. It should be recognized that more or less client computers can be included within a system such as described herein, and embodiments are therefore not constrained by the number or type of client computers employed.

Computers that can operate as client computer 12 can include computers that typically connect using a wired or wireless communications medium such as personal computers, multiprocessor systems, microprocessor-based or programmable electronic devices, network PCs, or the like. In some embodiments, client computers 12-16 can include virtually any portable personal computer capable of connecting to another computing device and receiving information, such as, laptop computer 13, smart mobile telephone 12, and tablet computers 15, and the like. However, portable computers are not so limited and can also include other portable devices, such as cellular telephones, radio frequency (RF) devices, infrared (IR) devices, Personal Digital Assistants (PDAs), handheld computers, wearable computers, integrated devices combining one or more of the preceding devices 16, and the like. As such, client computers 12-16 typically range widely in terms of capabilities and features. Moreover, client computers 12-16 are configured to access various computing applications, including a browser, or other web-based applications.

A web-enabled client computer can include a browser application that is configured to receive and to send web pages, web-based messages, and the like. The browser application can be configured to receive and display graphics, text, multimedia, and the like, employing virtually any web-based language, including a wireless application protocol messages (WAP), and the like. In one embodiment, the browser application is enabled to employ Handheld Device Markup Language (HDML), Wireless Markup Language (WML), WMLScript, JavaScript, JavaScript Object Notation (JSON), Standard Generalized Markup Language (SGML), HyperText Markup Language (HTML), eXtensible Markup Language (XML), and the like, to display and send a message. In one embodiment, a user of the client computer can employ the browser application to perform various activities over a network (online). However, another application can also be used to perform various online activities.

Client computers 12-16 can also include at least one other client application that is configured to receive and/or send content with another computer. The client application can include a capability to send and/or receive content, or the like. The client application can further provide information that identifies itself, including a type, capability, name, and the like. In one embodiment, client computers 12-16 can uniquely identify themselves through any of a variety of mechanisms, including an Internet Protocol (IP) address, a phone number, Mobile Identification Number (MIN), an electronic serial number (ESN), or other device identifier. Such information may be provided in a network packet, or the like, sent between other client computers, Data Collection Server Computer 10, Trending Unit Server Computer 20, or other computers.

Client computers 12-16 can further be configured to include a client application that enables an end-user to log into an end-user account that can be managed by another computer, such as Data Collection Server Computer 10, Trending Unit Server Computer 20, Social Media Server Computer 112*n*, Digital Content Object Source(s) Computer 102*n*, or the like. Such end-user account, in one non-limiting example, can be configured to enable the end-user to manage one or more online activities, including in one non-limiting example, search activities, social networking activities, browse various websites, communicate with other users, or the like. However, participation in such online activities can also be performed without logging into the end-user account.

Wireless network 18 is configured to couple client computers 14-16 and its components with network 11. Wireless network 18 can include any of a variety of wireless subnetworks that can further overlay stand-alone ad-hoc networks, and the like, to provide an infrastructure-oriented connection for client computers 14-16. Such sub-networks can include mesh networks, Wireless LAN (WLAN) networks, cellular networks, and the like. In one embodiment, the system can include more than one wireless network.

Wireless network 18 can further include an autonomous system of terminals, gateways, routers, and the like connected by wireless radio links, and the like. These connectors can be configured to move freely and randomly and organize themselves arbitrarily, such that the topology of wireless network 18 may change rapidly.

Wireless network 18 can further employ a plurality of access technologies including 2nd (2G), 3rd (3G), 4th (4G) 5th (5G) generation radio access for cellular systems, WLAN, Wireless Router (WR) mesh, and the like. Access technologies, such as 2G, 3G, 4G, 5G, and future access networks can enable wide area coverage for mobile devices, such as client computers 14-16 with various degrees of mobility. In one non-limiting example, wireless network 18 can enable a radio connection through a radio network access such as Global System for Mobil communication (GSM), General Packet Radio Services (GPRS), Enhanced Data GSM Environment (EDGE), code division multiple access (CDMA), time division multiple access (TDMA), Wideband Code Division Multiple Access (WCDMA), High Speed Downlink Packet Access (HSDPA), Long Term Evolution (LTE), and the like. In essence, wireless network 18 can include virtually any wireless communication mechanism by which information may travel between client computers 14-16 and another computer, network, and the like.

Network 11 is configured to couple network computers with other computers and/or computing devices, including, Data Collection Server Computer 10, Trending Unit Server Computer 20, Social Media Server Computer 112*n*, Digital Content Object Source(s) Computer 102*n*, client computers 12, 13 and client computers 14-16 through wireless network 18. Network 110 is enabled to employ any form of computer readable media for communicating information from one electronic device to another. Also, network 11 can include the Internet in addition to local area networks (LANs), wide area networks (WANs), direct connections, such as through a universal serial bus (USB) port, other forms of computer-readable media, or any combination thereof. On an interconnected set of LANs, including those based on differing architectures and protocols, a router acts as a link between LANs, enabling messages to be sent from one to another. In addition, communication links in LANs typically include twisted wire pair or coaxial cable, while communication links between networks can utilize analog telephone lines, full or fractional dedicated digital lines including T1, T2, T3, and T4, and/or other carrier mechanisms including, for example, E-carriers, Integrated Services Digital Networks (ISDNs), Digital Subscriber Lines (DSLs), wireless links including satellite links, or other communications links known to those skilled in the art. Moreover, communication links can further employ any of a variety of digital signalling technologies, including without limit, for example, DS-0, DS-1, DS-2, DS-3, DS-4, OC-3, OC-12, OC-48, or the like. Furthermore, remote computers and other related electronic devices could be remotely connected to either LANs or WANs via a modem and temporary telephone link. In one embodiment, network 11 can be configured to transport information of an Internet Protocol (IP). In essence, network 11 includes any communication method by which information can travel between computing devices.

Additionally, communication media typically embodies computer readable instructions, data structures, program modules, or other transport mechanism and includes any information delivery media. By way of example, communication media includes wired media such as twisted pair, coaxial cable, fiber optics, wave guides, and other wired media and wireless media such as acoustic, RF, infrared, and other wireless media.

One embodiment of a server computer that can be employed as a Data Collection Unit Server Computer 10 or a Trending Unit Server Computer 12 is described in more detail below in conjunction with FIG. 12. Briefly, server computer includes virtually any network computer capable of hosting the modules for the Data Collection Unit 10 and Trending Unit 20 as described herein. Computers that can be arranged to operate as a server computer include various network computers, including, but not limited to, desktop computers, multiprocessor systems, microprocessor-based or programmable consumer electronics, network PCs, server computers, network appliances, and the like.

Although FIG. 11 illustrates each of Data Collection Unit Server Computer 10 and Trending Unit Server Computer 20 as a single computer, the present disclosure is not so limited. For example, one or more functions of server computer can be distributed across one or more distinct network computers. Moreover, the computer servers are not limited to a particular configuration. Thus, in one embodiment, a server computer can contain a plurality of network computers. In another embodiment, a server computer can contain a plurality of network computers that operate using a master/slave approach, where one of the plurality of network computers of the server computers are operative to manage and/or otherwise coordinate operations of the other network computers. In other embodiments, a server computer can operate as a plurality of network computers arranged in a cluster architecture, a peer-to-peer architecture, and/or even within a cloud architecture. Thus, the present disclosure is not to be construed as being limited to a single environment, and other configurations, and architectures are also envisaged.

Although illustrated separately, Data Collection Unit Server Computer 10 and Trending Unit Server Computer 20 can be employed as a single network computer, separate network computers, a cluster of network computers, or the like. In some embodiments, either Data Collection Unit Server Computer 10 or Trending Unit Server Computer 20, or both, can be enabled to deliver content, respond to user interactions with the content, track user interaction with the content, update widgets and widgets controllers, or the like. Moreover, although Data Collection Unit Server Computer 10 and Trending Unit Server Computer 20 are described separately, it will be appreciated that these servers hosted by or configured to operate on Social Media Server Computer 112*n*, Digital Content Object Source(s) Computer 102*n* or other platforms.

Illustrative Network Computer

Figure 12:
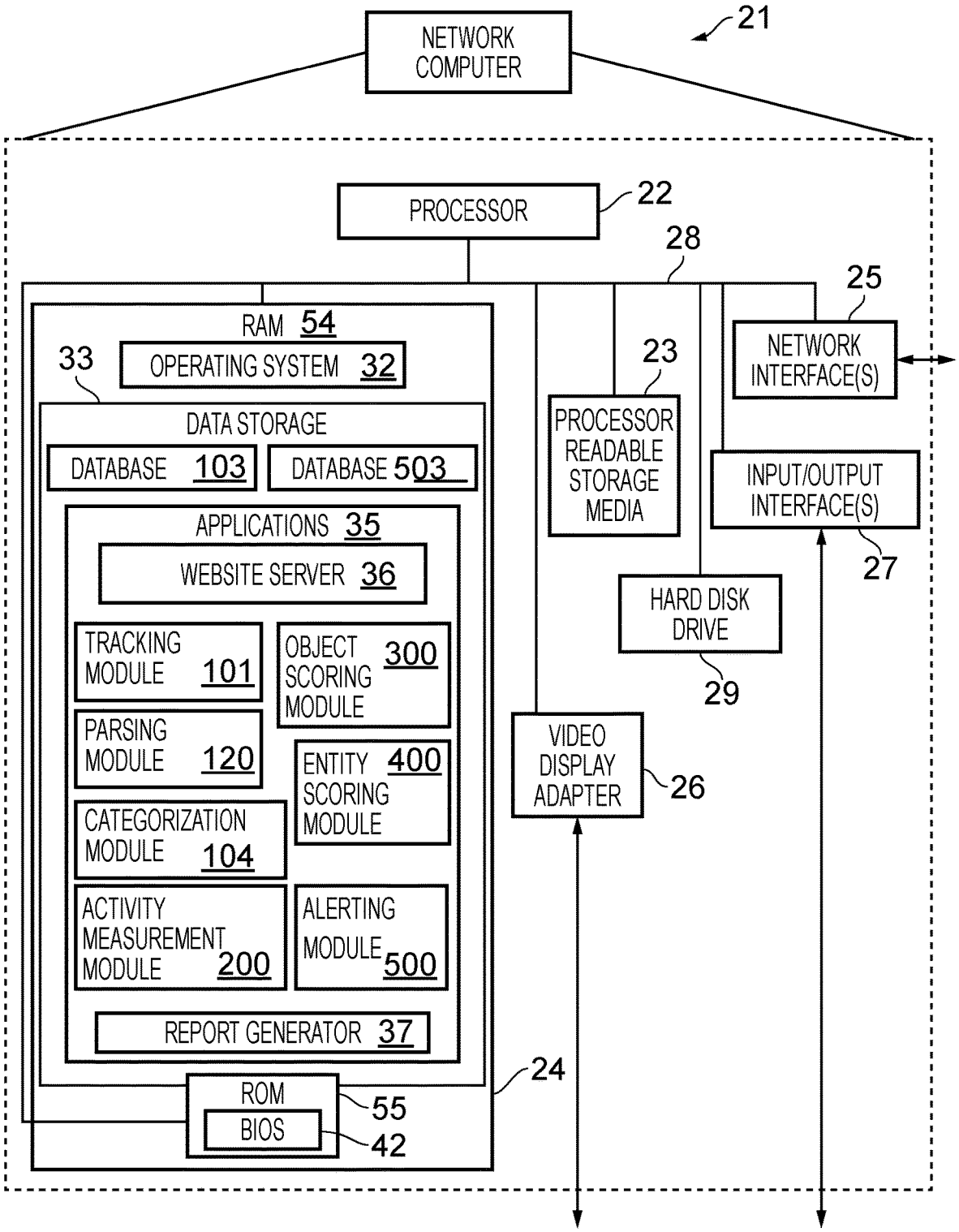
FIG. 12 shows an embodiment of a network computer that can be included in a system such as that shown in FIGS. 1 and 5.

FIG. 12 shows one embodiment of a network computer 21 according to one embodiment of the present disclosure. Network computer 21 can include many more or less components than those shown. The components shown, however, are sufficient to disclose an illustrative embodiment for practicing the invention. Network computer 21 can be configured to operate as a server, client, peer, a host, or any other computer. Network computer 21 can represent, for example Data Collection Unit Server Computer 10 and/or Trending Unit Server Computer 20 of FIG. 11, and/or other network computers.

Network computer 21 includes processor 22, processor readable storage media 23, network interface unit 25, an input/output interface 27, hard disk drive 29, video display adapter 26, and memory 24, all in communication with each other via bus 28. In some embodiments, processor 22 can include one or more central processing units.

As illustrated in FIG. 12, network computer 21 also can communicate with the Internet, or some other communications network, via network interface unit 25, which is constructed for use with various communication protocols including the TCP/IP protocol. Network interface unit 25 is sometimes known as a transceiver, transceiving device, or network interface card (NIC).

Network computer 21 also comprises input/output interface 27 for communicating with external devices, such as a keyboard, or other input or output devices not shown in FIG. 12. Input/output interface 27 can utilize one or more communication technologies, such as USB, infrared, Bluetooth™, or the like.

Memory 24 generally includes a Random Access Memory (RAM) 54, a Read Only Memory (ROM) 55 and one or more permanent mass storage devices, such as hard disk drive 29, tape drive, optical drive, and/or floppy disk drive. Memory 24 stores operating system 32 for controlling the operation of network computer 21. Any general-purpose operating system can be employed. Basic input/output system (BIOS) 42 is also provided for controlling the low-level operation of network computer 21.

Although illustrated separately, memory 24 can include processor readable storage media 23. Processor readable storage media 23 may be referred to and/or include computer readable media, computer readable storage media, and/or processor readable storage device. Processor readable storage media 23 can include volatile, non-volatile, removable, and non-removable media implemented in any method or technology for storage of information, such as computer readable instructions, data structures, program modules, or other data. Examples of processor readable storage media include RAM, ROM, EEPROM, flash memory or other memory technology, CD-ROM, digital versatile disks (DVD) or other optical storage, magnetic cassettes, magnetic tape, magnetic disk storage or other magnetic storage devices, or any other media that can be used to store the desired information and which can be accessed by a computer.

Memory 24 further includes one or more data storage 33, which can be utilized by network computer 21 to store, among other things, applications 35 and/or other data. For example, data storage 33 can also be employed to store information that describes various capabilities of network computer 21. The information can then be provided to another computer based on any of a variety of events, including being sent as part of a header during a communication, sent upon request, or the like. Data storage 33 can also be employed to store messages, web page content, or the like. At least a portion of the information can also be stored on another component of network computer 21, including, but not limited to processor readable storage media 23, hard disk drive 29, or other computer readable storage medias (not shown) within client computer 21.

Data storage 33 can include a database, text, spreadsheet, folder, file, or the like, that may be configured to maintain and store user account identifiers, user profiles, email addresses, IM addresses, and/or other network addresses; or the like.

In at least one of the various embodiments, data storage 33 can include databases, for example digital content object database 103, NER database (not shown), database 503 of panel tracking lists 505, and other databases that can contain information determined from digital content object tracking and social network activity metrics as described herein.

Data storage 33 can further include program code, data, algorithms, and the like, for use by a processor, such as processor 22 to execute and perform actions. In one embodiment, at least some of data store 33 might also be stored on another component of network computer 21, including, but not limited to processor-readable storage media 23, hard disk drive 29, or the like.

Applications 35 can include computer executable instructions, which may be loaded into mass memory and run on operating system 32. Examples of application programs can include transcoders, schedulers, calendars, database programs, word processing programs, Hypertext Transfer Protocol (HTTP) programs, customizable user interface programs, IPsec applications, encryption programs, security programs, SMS message servers, IM message servers, email servers, account managers, and so forth. Applications 35 can also include website server 36, Tracking Module 101, Parsing Module 120, Categorization Module 104, Activity Measurement Module 200, Object Scoring Module 300, Entity Scoring Module 400, Alerting Module 500 and Report Generator 37.

Website server 36 can represent any of a variety of information and services that are configured to provide content, including messages, over a network to another computer. Thus, website server 36 can include, for example, a web server, a File Transfer Protocol (FTP) server, a database server, a content server, or the like. Website server 36 can provide the content including messages over the network using any of a variety of formats including, but not limited to WAP, HDML, WML, SGML, HTML, XML, Compact HTML (cHTML), Extensible HTML (xHTML), or the like.

Tracking Module 101, Parsing Module 120, Categorization Module 104, and Activity Measurement Module 200 can be hosted and operative on Data Collection Unit Server Computer 10. In at least one of the various embodiments, Tracking Module 101, Parsing Module 120, Categorization Module 104, and Activity Measurement Module 200 can operate on Digital Collection Unit Server Computer 10 of FIG. 11. Tracking Module 101 may employ processes, or parts of processes, similar to those described in conjunction with FIGS. 1-7 to perform at least some of its actions.

Object Scoring Module 300 and Entity Scoring Module 400 can be hosted and operative on Trending Unit Server Computer 20 of FIG. 11. Object Scoring Module 300 and Entity Scoring Module 400 can employ processes, or parts of processes, similar to those described in conjunction with FIGS. 1-7 and FIG. 9 to perform at least some of its actions.

Alerting Module 500 can be hosted and operative on Trending Unit Server Computer 20 of FIG. 11. Alerting Module 500 can employ processes, or parts of processes, similar to those described in conjunction with FIGS. 8-13 and FIG. 15 to perform at least some of its actions.

Report Generator 37 can be arranged and configured to determine and/or generate reports based on the user filters and controls similar to those described above with reference to the user interface 30 controls. Also, report generator 37 can be configured to output a tailored report, either in the form of publishing software application which prepares and outputs a type-set digest of the digital content objects in a convenient-to-read form, or the same information output in a format suitable for automatic input and processing by another software product, for example plain text for a publishing program such as LaTeX. In at least one of the various embodiments, Report Generator 37 can be operative on hosted and operative on Trending Unit Server Computer 20 or Data Collection Unit Server Computer 10 of FIG. 1. Report Generator 37 can employ processes, or parts of processes, similar to those described in conjunction with FIGS. 1-7 and FIG. 9 to perform at least some of its actions.

Illustrative Client Computer

Figure 13:
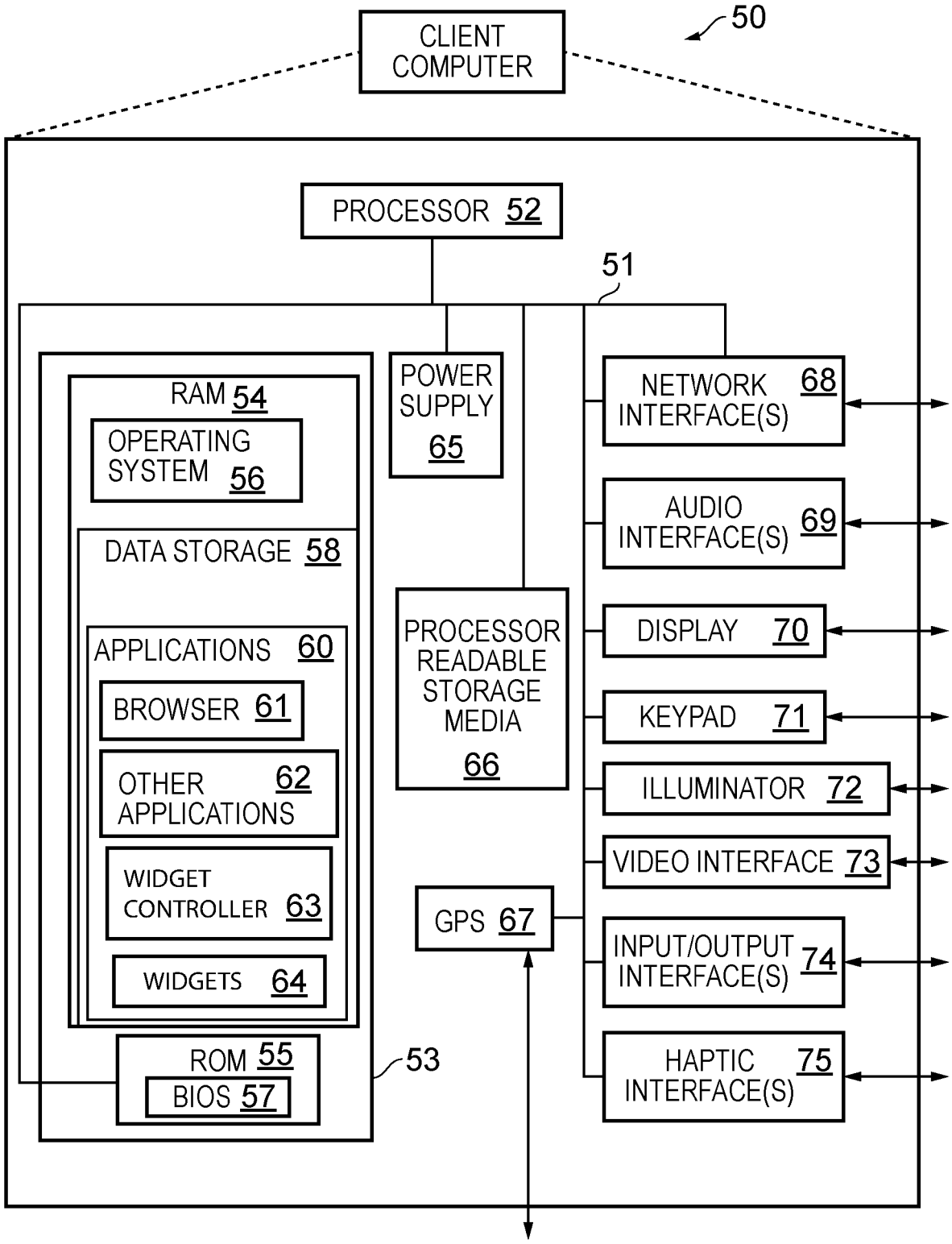
FIG. 13 shows an embodiment of client computer that can be included in a system such as that shown in FIGS. 1 and 5.

Referring to FIG. 13, client computer 50 can include many more or less components than those shown in FIG. 13. However, the components shown are sufficient to disclose an illustrative embodiment for practicing the present invention.

Client Computer 50 can represent, for example, one embodiment of at least one of Client Computers 12-16 of FIG. 11.

As shown in the figure, Client Computer 50 includes a processor 52 in communication with a mass memory 53 via a bus 51. In some embodiments, processor 50 includes one or more central processing units (CPU). Client Computer 50 also includes a power supply 65, one or more network interfaces 68, an audio interface 69, a display 70, a keypad 71, an illuminator 72, a video interface 73, an input/output interface 74, a haptic interface 75, and a global positioning system (GPS) receiver 67.

Power supply 65 provides power to Client Computer 51. A rechargeable or non-rechargeable battery can be used to provide power. The power can also be provided by an external power source, such as an alternating current (AC) adapter or a powered docking cradle that supplements and/or recharges a battery.

Client Computer 50 may optionally communicate with a base station (not shown), or directly with another computer. Network interface 68 includes circuitry for coupling Client Computer 50 to one or more networks, and is constructed for use with one or more communication protocols and technologies including, but not limited to, GSM, CDMA, TDMA, GPRS, EDGE, WCDMA, HSDPA, LTE, user datagram protocol (UDP), transmission control protocol/Internet protocol (TCP/IP), short message service (SMS), WAP, ultra wide band (UWB), IEEE 802.16 Worldwide Interoperability for Microwave Access (WiMax), session initiated protocol/real-time transport protocol (SIP/RTP), or any of a variety of other wireless communication protocols. Network interface 68 is sometimes known as a transceiver, transceiving device, or network interface card (NIC).

Audio interface 69 is arranged to produce and receive audio signals such as the sound of a human voice. For example, audio interface 69 can be coupled to a speaker and microphone (not shown) to enable telecommunication with others and/or generate an audio acknowledgement for some action.

Display 70 can be a liquid crystal display (LCD), gas plasma, light emitting diode (LED), organic LED, or any other type of display used with a computer. Display 70 can also include a touch sensitive screen arranged to receive input from an object such as a stylus or a digit from a human hand.

Keypad 71 can comprise any input device arranged to receive input from a user. For example, keypad 71 can include a push button numeric dial, or a keyboard. Keypad 71 can also include command buttons that are associated with selecting and sending images. Illuminator 72 can provide a status indication and/or provide light. Illuminator 72 can remain active for specific periods of time or in response to events. For example, when illuminator 72 is active, it can backlight the buttons on keypad 72 and stay on while the Client Computer is powered. Also, illuminator 72 can backlight these buttons in various patterns when particular actions are performed, such as dialing another client computer. Illuminator 72 can also cause light sources positioned in a transparent or translucent case of the client computer to illuminate in response to actions.

Video interface 73 is arranged to capture video images, such as a still photo, a video segment, an infrared video, or the like. For example, video interface 73 can be coupled to a digital video camera, a web-camera, or the like. Video interface 73 can comprise a lens, an image sensor, and other electronics. Image sensors may include a complementary metal-oxide-semiconductor (CMOS) integrated circuit, charge coupled device (CCD), or any other integrated circuit for sensing light.

Client computer 50 also comprises input/output interface 74 for communicating with external devices, such as a headset, or other input or output devices not shown in FIG. 13. Input/output interface 74 can utilize one or more communication technologies, such as USB, infrared, Bluetooth™, or the like.

Haptic interface 75 is arranged to provide tactile feedback to a user of the client computer. For example, the haptic interface 75 can be employed to vibrate client computer 75 in a particular way when another user of a computing computer is calling. In some embodiments, haptic interface 75 is optional.

Client computer 50 can also include GPS transceiver 67 to determine the physical coordinates of client computer 50 on the surface of the Earth. GPS transceiver 67, in some embodiments, is optional. GPS transceiver 67 typically outputs a location as latitude and longitude values. However, GPS transceiver 67 can also employ other geo-positioning mechanisms, including, but not limited to, triangulation, assisted GPS (AGPS), Enhanced Observed Time Difference (E-OTD), Cell Identifier (CI), Service Area Identifier (SAI), Enhanced Timing Advance (ETA), Base Station Subsystem (BSS), or the like, to further determine the physical location of client computer 50 on the surface of the Earth. It is understood that under different conditions, GPS transceiver 67 can determine a physical location within millimeters for client computer 50. In other cases, the determined physical location may be less precise, such as within a meter or significantly greater distances. In one embodiment, however, client computer 50 can, through other components, provide other information that can be employed to determine a physical location of the computer, including for example, a Media Access Control (MAC) address, IP address, or the like.

Mass memory 53 includes a Random Access Memory (RAM) 54, a Read-only Memory (ROM) 55, and other storage means. Mass memory 53 illustrates an example of computer readable storage media (devices) for storage of information such as computer readable instructions, data structures, program modules or other data. Mass memory 53 stores a basic input/output system (BIOS) 57 for controlling low level operation of client computer 50. The mass memory also stores an operating system 56 for controlling the operation of client computer 50. It will be appreciated that this component can include a general-purpose operating system such as a version of UNIX, or LINUX™, or a specialized client communication operating system such as Microsoft Corporation's Windows™ OS, Apple Corporation's iOS™, Google Corporation's Android™ or the Symbian® operating system. The operating system can include, or interface with a Java virtual machine module that enables control of hardware components and/or operating system operations via Java application programs.

Mass memory 53 further includes one or more data storages 58 that can be utilized by client computer 50 to store, among other things, applications 60 and/or other data. For example, data storage 58 can also be employed to store information that describes various capabilities of client computer 50. The information can then be provided to another computer based on any of a variety of events, including being sent as part of a header during a communication, sent upon request, or the like. Data storage 58 can also be employed to store social networking information including address books, buddy lists, aliases, user profile information, or the like. Further, data storage 58 can also store message, web page content, or any of a variety of user generated content. At least a portion of the information can also be stored on another component of client computer 50, including, but not limited to processor readable storage media 66, a disk drive or other computer readable storage devices (not shown) in client computer 50.

Processor readable storage media 66 can include volatile, non-volatile, removable, and non-removable media implemented in any method or technology for storage of information, such as computer- or processor-readable instructions, data structures, program modules, or other data. Examples of computer readable storage media include RAM, ROM, Electrically Erasable Programmable Read-only Memory (EEPROM), flash memory or other memory technology, Compact Disc Read-only Memory (CD-ROM), digital versatile disks (DVD) or other optical storage, magnetic cassettes, magnetic tape, magnetic disk storage or other magnetic storage devices, or any other physical medium that can be used to store the desired information and which can be accessed by a computer. Processor readable storage media 66 is also referred to herein as computer readable storage media and/or computer readable storage device.

Applications 60 can include computer executable instructions which, when executed by client computer 50, transmit, receive, and/or otherwise process network data. Network data includes, but is not limited to, messages (e.g. SMS, Multimedia Message Service (MMS), instant message (IM), email, and/or other messages), audio, video, and enable telecommunication with another user of another client computer.

Applications 60 can include, for example, browser 61, and other applications 62. Other applications 62 include, but are not limited to, calendars, search programs, email clients, IM applications, SMS applications, voice over Internet Protocol (VOIP) applications, contact managers, task managers, transcoders, database programs, word processing programs, security applications, spreadsheet programs, games, search programs, and so forth.

Browser 61 can include virtually any application configured to receive and display graphics, text, multimedia, messages, and the like, employing virtually any web based language. In one embodiment, the browser application employs HDML, WML, WMLScript, JavaScript, JSON, SGML, HTML, XML, and the like, to display and send a message. However, any of a variety of other web-based programming languages can be employed. In one embodiment, browser 61 enables a user of client computer 50 to communicate and interface with another network computer, such as Data Collection Unit Server Computer 10 and/or Trending Unit Server Computer 20, Social Media Server Computer 112*n*, Digital Content Object Source(s) Computer 102*n* of FIG. 11 such that a user can operate a user interface 30 as described herein.

Applications 60 can also include Widget Controller 63 and one or more Widgets 64. Widgets 64 can be collections of content provided to the client computer by Data Communication Server Computer 10, Trending Unit Server Computer 20, Social Media Server Computer 112*n*, or Digital Content Object Source(s) Computer 102*n*. Widget Controller 63 can be a program provided to the client computer by Data Communication Server Computer 10, Trending Unit Server Computer 20, Social Media Server Computer 112*n*, or Digital Content Object Source(s) Computer 102*n*. Widget Controller 63 and Widgets 64 can run as native client computer applications or they can run in Browser 61 as web browser based applications. Also, Widget Controller 63 and Widgets 64 can be arranged to run as native applications or web browser applications, or combination thereof. In one embodiment, browser 61 employs Widget Controller 63 and Widgets 64 to enable a user of client computer 50 to communicate and interface with another network computer, such as Data Collection Unit Server Computer 10 Trending Unit Server Computer 20, Social Media Server Computer 112*n* and/or Digital Content Object Source(s) Computer 102*n* of FIG. 11 such that a user can operate a user interface 30 as described herein.

Illustrative Graphical User Interface

Figure 14:
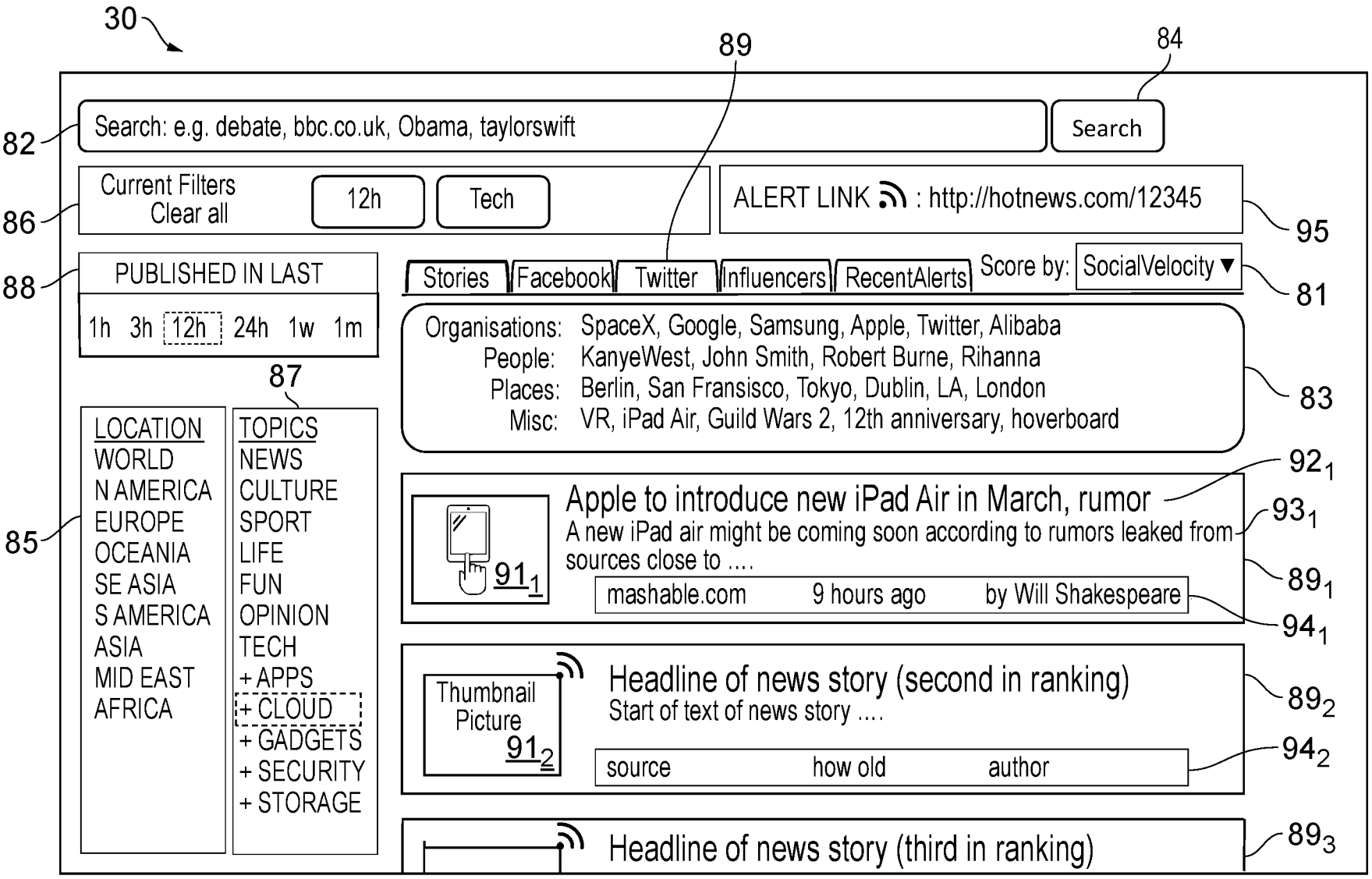
FIG. 14 shows an example graphical user interface according an embodiment.

Referring to FIG. 14, in at least one of the various embodiments, user interfaces other than user interface 30, can be employed without departing from the spirit and/or scope of the present disclosure. Such user interfaces can have more or fewer user interface elements that are arranged in various ways. In some embodiments, user interfaces can be generated using web pages, mobile applications, emails, PDF documents, text messages, or the like. In at least one of the various embodiments, Tracking Module 101, Parsing Module 120, Categorization Module 104, Activity Measurement Module 200, Object Scoring Module 300, Entity Scoring Module 400 and/or Alerting Module 500 include processes and/or API's for generating user interfaces, such as, user interface 30.

The user interface unit 80 is now described in more detail.

FIG. 14 shows a home screen user interface 30 as an example user graphical user interface, referred to as a dashboard. A search entry box 82 with adjacent action button 84 allows a user to type in a search query to be searched by a search engine that forms part of the system. The search engine (e.g. ElasticSearch) allows a search of all available digital content objects such as stories in the system. The search query can be a general one using keywords and can also specify one or more domains in which the search should be restricted. A bar 86 across the screen shows the filters that are currently being applied together with a "Clear all" button option to reset to no filtering. There are currently two active filters shown, one "12 h" indicating that only news stories in the last 12 hours are included in the results and another "Tech" showing that only news stories with the subject (i.e. category) of technology are included.

An area 88 is for a time-based filter indicating the time period up to the present time over which the search is restricted, namely last hour, last three hours, last twelve hours, last 24 hours, last week and last month. A dashed box around twelve hours indicates that this period has been selected.

A tabs bar 89 shows various filter options that provide restrictions on the activity measurement module 200. Some illustrated tabs are for filtering according to the source social media platform, such as Facebook or Twitter, where the activity has taking place. Another illustrated tab is by "Influencers." The selected tab, which is the one currently selected as schematically illustrated by the bold highlighting, is for "Stories." The "Stories" tab is also the one relevant for the story and entity ranking approach described above. Further, a tab "Recent Alerts" is provided for previously alerted stories, which only shows news stories that have previously been alerted, which will also advantageously include some time filter, which may be the filter in area 88, or may be a period of time related to when the alert took place, e.g. alerted in the last 24 hours. Although not illustrated, it may also be desirable to include an inverse tab which only shows news stories that have not (yet) been alerted.

An input field 81 is also provided which, from a drop down list, allows the stories to be sorted by most recent, social media source (e.g. "Facebook"), highest velocity (e.g., stories sorted by trending of interactions—for example change measurements or other activity measurements as described herein), engagement type (e.g. "Tweets" or "Facebook Shares") or combined social network sources (e.g. "Facebook+Twitter+Pinterest").

A navigation panel 83 shows the entity ranking results by each of the four standard entity categories: organizations, persons, locations or other text elements, which on the dashboard are labeled: Organisations, People, Places and Misc. The entity ranking list for each category, as obtained by the methods and system components described above is also illustrated, for example for locations: Berlin, San Francisco, Tokyo, Dublin, LA, and London. In the embodiment shown, Berlin is the location entity with the highest entity ranking score, San Francisco the second highest and so forth.

On the left hand side there is a column 85 that allows location-based category filters, labeled, for example, with categories, such as WORLD, NORTH AMERICA, EUROPE and the like. Adjacent thereto, another column 87 for topic based category filters labeled, for example, with topics such as, NEWS, CULTURE, SPORT, and the like. The TECH category is shown as currently selected, which also causes various sub-categories to be displayed, such as APPS, CLOUD, and the like, thereby allowing the filter to be further specified to look only under one of these subcategories. Underneath the navigation panel 83, there appears a ranked list of news stories in individual story cards, with the top ranking story card appearing at 891, the second ranked story card at 892, the third ranked story card at 893 and so forth, with lower ranking stories being found by scrolling down. Each story card 89*n* has a thumbnail picture 91*n*, a headline 92*n*, a story summary text 93*n* and an information panel 94*n*.

If the news story has already been alerted, an alert icon or other visual indicator may be placed somewhere in or near the story card, such as on the top right corner of the thumbnail picture 91 as illustrated for the second and third ranked stories 892 and 893 (but not the first ranked story 891).

The information panel contains details about the origin of the news story, for example as shown: a hyperlink to the home page of the news story source's website, an indication of the age of the news story and the name of the author. Other information, such as the country of origin of the news story could also be given, e.g. with a logo of the relevant national flag.

An alert link box 95 is included which is normally blank, but flashes up when the user is alerted of a news story and includes a hyperlink to the news story. The hyperlink will normally only remain for a period of time, e.g. a number of minutes, so it retains topicality, whereafter the alert link box 95 reverts to an unfilled status. Alternatively, the content of the last alert may remain until a new alert occurs, but is displayed less prominently after the period of time. The period of time in both cases may be fixed or may relate to the desired alert frequency specified by the user. The stories are ranked and shown in ranking order on the story cards according to the story score. In the embodiment, as shown in FIG. 14, the time filter in area 88 is configured to show all the ranked stories in the selected time period (e.g., the last 12 hours). The navigation panel 83 of the user interface 30 is also configured to show the entity rankings showing the trending entities in the stories. In an embodiment, a user can pre-define a panel to filter stories by a specific set of user-defined criteria, which will typically include keywords and categories, but could also include domains, entities or other criteria. By applying these criteria as well as the time filter, a group of news stories can be identified. Trending entities that have been extracted and ranked as described herein can also be shown.

In an embodiment, the user interface 30 is configured to allow a user to use the named entities as a filter for the stories. For example, in an embodiment, the user can click on the navigation panel to select a particular entity of interest, e.g. Berlin, then the interface filters out and does not display stories that do not mention that entity, i.e. Berlin. Additionally, if the user has entered something into the search entry box 82, then keywords, for example any entities mentioned in the search text, are used as filters. In other words, news stories that mention multiple entities entered into the search entry box will be given a higher ranking than those that mention only one.

In another embodiment, the system can be configured to allow a user to apply pre-defined user criteria such that if the user has not specified any of the entities in the navigation panel, then the story cards only show stories that contain a reference to at least one top ranking entity. For example, the story ranking list can be weeded to remove all stories that do not mention one of the top 10 ranked entities. However, in other embodiments, the system can be configured to show entity rankings trending entities in the stories without filtering ranked stories that do not include any ranked entities—i.e. showing all ranked stories regardless of whether they include a named entity or not. In either embodiment, the system can be configured to allow a user to proactively use named entities as a filter, for example by clicking on the named entity in the ranking as described above.

As noted herein, in an embodiment, a user can pre-define a panel to filter stories by a specific set of user-defined criteria, which will typically include keywords and categories, and can also include domains, entities or other criteria. By applying these criteria as well as the time filter, a group of news stories can be identified. Trending entities that have been extracted and ranked as described herein can also be shown. FIG. 14 shows a panel configurator of the graphical user interface (GUI) 30 through which a user can configure the parameters of digital content objects he or she wishes to be alerted on through a panel specification for optimized alerting. For example, as shown in FIG. 14, a user with username "Redfox" can configure a new panel in order to track news stories about the football (soccer) club that he supports, "Manchester United." The user enters a memorable short name for the panel ('ManU') and the panel is also assigned a unique ID by the system ('438192').

The user is prompted by a navigation panel 83 to enter criteria under each of the four predetermined entity categories: organizations, persons, locations or other text elements, which on the panel configurator are labelled: Organisations, People, Places and Misc. In this example, "Manchester United" has been entered by the user as an entity, along with other related entities, various personnel associated with the club (e.g. Wayne Rooney, Jose Mourinho), places (e.g.

Manchester) and miscellaneous tags have also been entered (e.g. transfer, injury). An area 88 is for a time-based filter indicating the time period up to the present time over which the search is to be restricted, namely last hour, last three hours, last twelve hours, last 24 hours, last week and last month. A dashed box around 24 hours indicates that this period has been selected. On the left hand side there is a column 85 that allows location-based category filters, labelled, for example, with categories, such as WORLD, NORTH AMERICA, EUROPE and the like. Europe is shown selected by the user, since Manchester is in Europe. Adjacent thereto, another column 87 for topic-based category filters labelled, for example, with topics such as, NEWS, CULTURE, SPORT, and the like, which can be further expanded into sub-topics in a tree structure. The FOOTBALL sub-category of SPORT has been selected by the user in the illustrated GUI. A further input field 97 allows domains to be specified. Another input field 99 allows search keywords to be specified. A still further input field 98 allows the user to tag one or more social networks which are to be used to monitor the random variable, e.g. social velocity, assuming that there is to be a restriction of this kind. In the illustration, Facebook and Reddit are tagged.

The panel also has an input menu 81 by which the panel is configured to allow the user to specify the variable to be used as the basis determining variable values such as scoring, and thus also alerting. The illustrated variable is social velocity, by which, when selected, the system is configured to alert the user about digital content objects based on their social velocity compared with the peak social velocity reached by comparable digital content objects, e.g., stories sorted by trending of interactions—for example change measurements or other activity measurements as described herein. Social velocity can be taken from the score for the digital content object itself, as determined by the object scoring module 300. Other variables can be used, for example, entity scores from the entity scoring module 410.

Once the user has finished the panel configuration, the user activates and stores the panel with the set button 251 in the top-right corner of the GUI. The configurator also has a delete button 252 positioned in the bottom-right corner of the GUI by which a user can delete a panel, e.g. after opening an existing panel for editing and then deciding the panel is no longer wanted.

The user interface 30 has been described using the example of a dashboard suitable for a personal computer, as this is an amenable form for the purpose of explanation. Similar graphical user interfaces with a dashboard format can also be provided as a mobile app, e.g. for Android or iPhone operating systems, where the term "mobile app" refers primarily to a module of applications software capable of running on a smart phone or tablet device or other client computer. Other types of user interface can also be provided. An alternative user interface type is an application programming interface (API), which is the type of user interface which would be suitable for developers who wish to integrate the system as described herein with a third party software application, e.g. to incorporate outputs from the trending unit 20 in a flexible manner suited to the third party applications software which is being integrated. Another user interface type would be a report writing software application, which, based on user filters and controls similar to those described above with reference to the dashboard, will output a tailored report, either in the form of publishing software application which prepares and outputs a type-set digest of the news stories in a convenient-to-read form, or the same information output in a format suitable for automatic input and processing by another software product, for example plain text for a publishing program such as LaTeX.

It will thus be understood that certain implementations of the user interface 30 will have the ability to configure settings in the trending unit 20 as illustrated by the communications path between the user interface 30 and the trending unit 20, for example, in the story scoring module 300, the entity scoring module 400, and or the alerting unit 500. In addition, certain implementations of the user interface 30 will have the ability to reach through into the data collection unit 10 and extract news story data selected by the trending unit 20 based on the configuration of the user interface unit 30 as also illustrated by a communications path between these two units in FIG. 1.

The operation of certain aspects of the present disclosure have been described with respect to flowchart illustrations. In at least one of various embodiments, processes described in conjunction with FIGS. 1 to 18, can be implemented by and/or executed on a single network computer. In other embodiments, these processes or portions of these processes can be implemented by and/or executed on a plurality of network computers. Likewise, in at least one of the various embodiments, processes or portions thereof, can operate on one or more client computers, such as client computer. However, embodiments are not so limited, and various combinations of network computers, client computers, virtual machines, or the like can be used. Further, in at least one of the various embodiments, the processes described in conjunction with the flowchart illustrations can be operative in system with logical architectures, such as those described in herein.

It will be understood that each block of the flowchart illustrations described herein, and combinations of blocks in the flowchart illustrations, can be implemented by computer program instructions. These program instructions can be provided to a processor to produce a machine, such that the instructions, which execute on the processor, create means for implementing the actions specified in the flowchart block or blocks. The computer program instructions can be executed by a processor to cause a series of operational steps to be performed by the processor to produce a computer-implemented process such that the instructions, which execute on the processor to provide steps for implementing the actions specified in the flowchart block or blocks. The computer program instructions can also cause at least some of the operational steps shown in the blocks of the flowchart to be performed in parallel. Moreover, some of the steps can also be performed across more than one processor, such as might arise in a multi-processor computer system or even a group of multiple computer systems. In addition, one or more blocks or combinations of blocks in the flowchart illustration can also be performed concurrently with other blocks or combinations of blocks, or even in a different sequence than illustrated without departing from the scope or spirit of the present disclosure.

Accordingly, blocks of the flowchart illustrations support combinations for performing the specified actions, combinations of steps for performing the specified actions and program instruction means for performing the specified actions. It will also be understood that each block of the flowchart illustrations, and combinations of blocks in the flowchart illustrations, can be implemented by special purpose hardware-based systems, which perform the specified actions or steps, or combinations of special purpose hardware and computer instructions. The foregoing examples should not be construed as limiting and/or exhaustive, but rather, as illustrative use cases to show an implementation of at least one of the various embodiments of the present disclosure.

What is claimed is:

1. A method for processing digital content objects, the method being performed by a computer system that comprises one or more processors and a computer-readable storage medium encoded with instructions executable by at least one of the processors and operatively coupled to at least one of the processors, the method comprising:

accepting input configuring a digital content object panel specification to define a set of alert criteria for digital content objects of interest, wherein the digital content objects include digitally published news stories;

applying the panel specification to a database of one or more digital content objects from one or more tracked digital content object news story sources in order to obtain a batch of digital content objects matching the panel specification;

determining a value of a variable for each of the digital content objects of the batch of digital content objects matching the panel specification, wherein the variable is based on at least one social media activity metric associated with the digital content objects in at least one social network;

fitting the values of each of the digital content objects of the batch for the variable to a distribution function in order to determine parameter values for the distribution function;

determining a threshold value for alerting based on the parameterized distribution function;

determining a value of the variable for an additional digital content object matching the panel specification;

alerting a user to the additional digital content object conditional on the value of the variable for the additional digital content object exceeding the threshold value;

continually updating the batch of digital content objects matching the panel specification;

refitting the values of each of the updated digital content objects of the batch for the variable to reparametrize the distribution function in order to update the parameter values for the reparametrized distribution function; and updating the threshold value for alerting based on the reparametrized distribution function.

2. The method of claim 1, wherein the social media activity metric is one or more metric selected from the group: a share, a like, and a comment.

3. The method of claim 1, wherein the social media activity metric is one or more metric selected from the group: a tweet of a hyperlink, and a retweet of a hyperlink.

4. The method of claim 1, wherein the social media activity metric is a share of the content.

5. The method of claim 1, wherein the value is based on size of the social media activity metric over one of: a defined period of time; at least two defined periods of time; and at least three defined periods of time.

6. The method of claim 1, wherein the distribution function is a 2-parameter Weibull function.

7. The method of claim 1, further comprising:

defining a desired frequency of alerts;

monitoring the actual frequency of alerts over a set period of time;

comparing the actual frequency of alerts to the desired frequency of alerts; and adjusting the threshold value according to the difference between actual and desired frequencies of alerts.

8. A computer program stored on a computer readable medium and loadable into the internal non-transitory memory of a digital computer, comprising software code portions, when said program is run on a computer, for performing the method of claim 1.

9. A computer program product storing the computer program of claim 8.

10. A computer system comprising:

a data collection unit configured to collect social media data from one or more social media platforms and a batch of digital content objects from one or more digital content object news story sources, wherein the digital content objects include digitally published news stories;

a trending unit configured to analyze the batch of digital content objects with an object scoring module; and a user interface unit configured to communicate with a user, wherein:

the user interface unit is configured to permit a user to configure a digital content object panel specification to define a set of alert criteria for digital content objects and subsequently to send alerts to the user regarding digital content objects that match the panel specification, an alerting module is configured to apply the panel specification to a database of digital content objects and obtain the batch of digital content objects matching the panel specification, and the alerting module is configured to:

determine a value of a variable for each of the digital content objects of the batch of digital content objects matching the panel specification, wherein the variable is based on at least one social media activity metric associated with the digital content objects in at least one social network;

fit the values of the variable for each of the digital content objects to a distribution function to determine parameter values for the distribution function;

determine a threshold value for alerting based on the parameterized distribution function;

determine a value of the variable for an additional digital content object matching the panel specification;

instruct the user interface unit to alert to the additional digital content object conditional on the value of the variable for the additional digital content object exceeding the threshold value;

continually update the batch of digital content objects matching the panel specification;

refit the values of each of the updated digital content objects of the batch for the variable to reparametrize the distribution function in order to update the parameter values for the reparametrized distribution function; and update the threshold value for alerting based on the reparametrized distribution function.

11. The computer system of claim 10, wherein the social media activity metric is one or more metric selected from the group of: a share, a like, and a comment.

12. The computer system of claim 10, wherein the social media activity metric is one or more metric selected from the group of: a tweet of a hyperlink, and a retweet of a hyperlink.

13. The computer system of claim 10, wherein the social media activity metric is a share of the content.

14. The computer system of claim 10, wherein the value is based on size of the social media activity metric over one of: a defined period of time; at least two defined periods of time; and at least three defined periods of time.

15. The computer system of claim 10, wherein the distribution function is a 2-parameter Weibull function.

16. The computer system of claim 10, wherein the trending unit is further operable to:

define a desired frequency of alerts;

monitor the actual frequency of alerts;

compare the actual frequency of alerts to the desired frequency of alerts; and adjust the threshold value according to the difference between actual and desired frequencies of alerts.

17. The computer system of claim 10, wherein the user interface unit is configured allow a user to enter the set of criteria under a plurality of predetermined categories.

18. The computer system of claim 10, wherein the set of criteria define a search definition.

19. The computer system of claim 18, wherein the user interface is configured to allow a user to apply one or more filters for the search.

20. The computer system of claim 19, wherein the filters include filters selected from the group of: a time period, a category filter, a topic filter, a domain name filter, and a social network filter.

21. The computer system of claim 10, wherein the system is configured to allow the user to include a keyword search.

22. The computer system of claim 10, wherein the variable is selected from the group of: a social velocity variable, a social weight variable, a social acceleration variable, and an entity rank variable.

23. The computer system of claim 22, wherein the value for the social velocity variable includes a value determined from a social velocity score.

24. The computer system of claim 10, wherein the system is configured to at least:

identify a digital content object as having been alerted to a user; and not subsequently provide an alert to the user for the marked digital content object even if the alerting module determines the value of the variable for the digital content object exceeds the threshold value.

25. The computer system of claim 24, wherein the marking comprises:

storing a list of tracked digital content objects matching the panel specification;

tagging any digital content objects that have been alerted to the user; and not provide the alert for any tagged digital content objects.

26. The computer system of claim 24, wherein the marking comprises:

storing a list of tracked digital content objects matching the panel specification;

removing any digital content objects that have been alerted to the user from the list of tracked digital content objects; and adding the digital content objects that have been alerted to the user to a separate list of alerted digital content objects.

* * * * *